US009410316B2

(12) United States Patent
Reigstad

(10) Patent No.: US 9,410,316 B2
(45) Date of Patent: Aug. 9, 2016

(54) POST-TENSION CONCRETE LEAVE OUT SPLICING SYSTEM AND METHOD

(71) Applicant: REIGSTAD & ASSOCIATES, INC., Saint Paul, MN (US)

(72) Inventor: Gordon H. Reigstad, Saint Paul, MN (US)

(73) Assignee: Reigstad & Associates, Inc., Saint Paul, MN (US)

( * ) Notice: Subject to any disclaimer, the term of this patent is extended or adjusted under 35 U.S.C. 154(b) by 0 days.

(21) Appl. No.: 14/581,720

(22) Filed: Dec. 23, 2014

(65) Prior Publication Data

US 2015/0176278 A1 Jun. 25, 2015

Related U.S. Application Data

(60) Provisional application No. 61/920,581, filed on Dec. 24, 2013.

(51) Int. Cl.

| | |
|---|---|
| ***E04B 5/32*** | (2006.01) |
| ***E04C 5/06*** | (2006.01) |
| ***E04B 5/02*** | (2006.01) |
| ***E04B 5/04*** | (2006.01) |
| *E04B 5/17* | (2006.01) |

(52) U.S. Cl.

CPC . *E04B 5/32* (2013.01); *E04B 5/023* (2013.01); *E04B 5/04* (2013.01); *E04C 5/0645* (2013.01); *E04B 2005/176* (2013.01); *E04B 2005/324* (2013.01)

(58) Field of Classification Search

CPC ..... E04C 5/162; E04C 5/163; E04C 5/165; E04C 5/168; E04C 5/0645; E04B 1/06; E04B 1/043; E04B 1/22; E04B 5/023; E04B 5/32; E04B 2005/324; E04B 2103/02; E04B 5/04

USPC ..... 52/223.6, 223.7, 583.1, 742.14, 742.16, 52/223.8, 223.9, 223.11, 223.13, 223.14

See application file for complete search history.

(56) References Cited

U.S. PATENT DOCUMENTS

| | | | | |
|---|---|---|---|---|
| 2,181,623 | A | 11/1939 | Klein | |
| 2,611,262 | A * | 9/1952 | Dodson et al. | 52/223.13 |
| 3,089,215 | A * | 5/1963 | Stubbs | E01C 11/20 254/29 A |
| 3,295,286 | A * | 1/1967 | Schaich | 52/583.1 |
| 3,369,334 | A | 2/1968 | Berg | |
| 3,478,481 | A * | 11/1969 | Schuppisser et al. | 52/432 |
| 3,555,753 | A | 1/1971 | Magadini | |
| 3,691,708 | A * | 9/1972 | Firnkas | 52/470 |
| 3,782,061 | A * | 1/1974 | Minutoli et al. | 52/125.5 |
| 3,869,530 | A * | 3/1975 | Williams | 264/33 |
| 3,952,468 | A | 4/1976 | Sourn | |
| 4,024,688 | A * | 5/1977 | Calini | 52/378 |
| 4,099,360 | A * | 7/1978 | Outram | 52/745.18 |
| 4,324,081 | A * | 4/1982 | Chicha | 52/432 |
| 4,627,203 | A * | 12/1986 | Presswalla | E04B 5/32 174/96 |

(Continued)

*Primary Examiner* — Joshua J Michener
*Assistant Examiner* — Theodore Adamos
(74) *Attorney, Agent, or Firm* — Hamre, Schumann, Mueller & Larson, P.C.

(57) ABSTRACT

Devices, systems, and methods for constructing post-tensioned concrete slabs in a new floor construction that has a reduced gap distance between the slabs. The devices, systems, and methods can improve project construction time by reducing the time delay in accessing the floor underneath the slabs due to safety and/or weather conditions.

20 Claims, 19 Drawing Sheets

(56) References Cited

U.S. PATENT DOCUMENTS

| | | | | | |
|---|---|---|---|---|---|
| 4,627,212 | A * | 12/1986 | Yee | 52/848 | |
| 4,692,052 | A | 9/1987 | Yee | | |
| 4,695,178 | A | 9/1987 | Era et al. | | |
| 4,781,006 | A | 11/1988 | Haynes | | |
| 4,919,122 | A | 4/1990 | Kohlenbrenner | | |
| 5,123,220 | A * | 6/1992 | Simenoff | 52/252 | |
| 5,134,828 | A * | 8/1992 | Baur | 52/704 | |
| 5,305,573 | A * | 4/1994 | Baumann | 52/848 | |
| 5,366,672 | A * | 11/1994 | Albrigo et al. | 264/35 | |
| 5,606,839 | A * | 3/1997 | Baumann | 52/848 | |
| 5,664,902 | A | 9/1997 | Holdsworth | | |
| 5,669,196 | A | 9/1997 | Dahl | | |
| 5,821,463 | A | 10/1998 | Ngo | | |
| 5,909,980 | A | 6/1999 | Holdsworth | | |
| 5,974,761 | A | 11/1999 | Mochizuki et al. | | |
| 6,065,263 | A | 5/2000 | Taguchi | | |
| 6,192,647 | B1 * | 2/2001 | Dahl | 403/300 | |
| 6,389,774 | B1 | 5/2002 | Carpenter | | |
| 6,402,435 | B1 * | 6/2002 | Lewis | E02D 29/0216 405/262 | |
| 6,532,711 | B2 | 3/2003 | Gregel et al. | | |
| 6,668,412 | B1 | 12/2003 | Tadros et al. | | |
| 6,679,024 | B2 * | 1/2004 | Dahl | 403/265 | |
| 7,556,208 | B1 | 7/2009 | Reichel | | |
| 8,387,328 | B2 | 3/2013 | Gentil | | |
| 8,413,396 | B2 * | 4/2013 | Oliva et al. | 52/309.1 | |
| 8,636,441 | B2 * | 1/2014 | French | 404/45 | |
| 8,904,721 | B2 | 12/2014 | Pantelides et al. | | |
| 2004/0238558 | A1 | 12/2004 | Frohlich | | |
| 2005/0072103 | A1 | 4/2005 | Hopwood | | |
| 2005/0169701 | A1 | 8/2005 | Kies et al. | | |
| 2006/0067785 | A1 | 3/2006 | Holdsworth | | |
| 2006/0137115 | A1 * | 6/2006 | Park | E01D 2/02 14/74.5 | |
| 2007/0095013 | A1 | 5/2007 | Kerkay | | |
| 2008/0060291 | A1 | 3/2008 | Braun | | |
| 2009/0263189 | A9 * | 10/2009 | Koivunen | 403/379.4 | |
| 2011/0099941 | A1 * | 5/2011 | Yegge | E04C 3/26 52/831 | |

* cited by examiner

POST-TENSION CONCRETE LEAVE OUT SPLICING SYSTEM AND METHOD

FIELD

This description relates generally to floor construction using post-tensioned concrete slabs.

BACKGROUND

Generally, a process for new floor construction using post-tensioned concrete slabs requires a gap (also known as a leave out, a pour strip out, etc.) that separates adjacent concrete slabs (also known as pours or castings). Generally, the gap is four feet and more in length. That is, several feet in distance separates the two ends of the post-tensioned concrete slabs. Sometimes the gap distance (the distance which separates the two ends of the post-tensioned concrete slabs) may be called a "width," but for clarity and consistency, the term "width" is used herein to describe the distance along the direction labeled "W," and the term "length" is used herein to describe the distance along the direction labeled "L" (e.g., see FIGS. 1-3). Accordingly, ΔL is used herein to describe a change in distance along the "L" axis direction. Generally, the gap is filled in (i.e., lap spliced) with a pour strip at a later time, connecting the slabs together to form the entire floor.

Prestressed concrete is a type of reinforced concrete which has been subjected to external compressive forces prior to the application of load. Prestressed concrete is categorized as either pre-tensioned or post-tensioned.

Pre-tensioned concrete is formed by a process including initial stressing of a wire strand system and then casting concrete around the stressed wire strand system. The stress from the wire strand system transfers to the concrete after the concrete has reached a specified strength (e.g., cured to a set specification).

Post-tensioned concrete is formed by a process of casting wet concrete around an unstressed wire strand system and then stressing the wire strand system after the concrete has reached specified strength (e.g., cured to a set specification). For example, post-tensioned concrete can have a wire strand system which has a wire enclosed in a duct (e.g., pipe, conduit, etc.). Concrete is formed around the duct and the concrete sets and cures. Then, the wire is stressed and grout material (e.g., a mixture of cement, sand, aggregate, and water) is pumped into the cavity surrounding the wire. The grout material bonds the wire to the duct, and the duct is bonded to the cured concrete. Thus, the stress applied to the wire can be transferred to the concrete. The applied stress (e.g., forces applied to the wire strand system) in the post-tensioning process causes a volume change (and/or a length change) to the concrete material. The volume change of the concrete material causes a change in the length of the concrete slab. The length change is a shortening in the direction parallel to applied stress (e.g., the post-tensioning force).

FIGS. 1-2 show schematic diagrams of a floor construction 10 according to a generally known process using post-tensioned concrete. FIG. 1 shows a top-down plan view of the floor construction 10. The floor construction 10 includes post tensioned slabs 12, 14 separated by a gap 16. FIG. 1 shows the "width" direction indicated by "W" and the "length" direction indicated by "L" (FIGS. 2 and 3 also show the length direction indicated by "L"). FIG. 2 shows a side view of the floor construction 10, also showing the slabs 12, 14, and the gap 16. The floor construction 10 is made by a process wherein the post tensioned slabs 12, 14 are each poured separately, tensioned independent of each other after they have sufficiently cured. Thus, the rebars in the post-tensioned slab 12 do not necessarily lineup (e.g., axially) with the rebars in the post-tensioned slab 14.

Each of the slabs 12, 14 changes volume due to their tensioning processes. The typical tensioning process for a typical floor construction uses the gap 16, which is typically four to eight feet in length, for accommodating appropriate tooling and equipment (and also for access by workers) to tension the slabs 12, 14. Further, the gap 16 (i.e., the separation between the two slabs 12, 14) becomes longer (e.g., along direction L shown in FIG. 1) during and after the tensioning of one or both of the slabs 12, 14. That is, the volume changes in the slabs 12, 14 and the slabs 12, 14 become shorter. And because the slabs 12, 14 become shorter, the separation between them, which is the gap 16, becomes longer.

For example, in a typical hotel floor construction, the gap 16 can be about sixty to seventy feet in width and four to eight feet in length. Generally, the gap 16 is left open for twenty to thirty days to allow most of the volume changes (i.e., slab shortening) to occur to the post-tensioned concrete slabs 12, 14. After the twenty to thirty days, the gap 16 is filled in (i.e., lap spliced) with a pour strip 18 to provide a structural continuity of the floor construction 10 required by the final design to resist all required loads.

FIG. 3 shows a close-up schematic view of a portion 20 of the floor construction 10 shown in FIG. 2. The portion 20 shows the first slab 12 having a post-tensioning wire strand system 22 for stressing the concrete 23. The slab 12 includes a steel reinforcing bar 24 (also known as rebar) which reinforces the concrete 23 in the slab 12. Generally, the rebar 24 and other rebar in the slab 12 are somewhat regularly positioned in the slab 12, and extend out from the end of the slab 12 towards the gap 16. The second slab 14, which is also shown in the portion 20, has its own post-tensioning wire strand system 26 for stressing the concrete 27. The slab 14 includes a rebar 28 which reinforces the concrete 27 in the slab 14. Generally, the rebar 28 and other rebar in the slab 14 are somewhat regularly positioned in the slab 14, and extend out from the end of the slab 14 towards the gap 16. In the prior art process of forming the floor construction 10, the positioning of the rebar 28 is not based on or with respect to the position of the rebar 24. Further, prior to the filling in of the gap 16 with the pour strip 18, the rebar 24 extending out from the slab 12 is not connected to the rebar 28 extending out from the slab 14. That is, prior to the filling in of the gap 16 with the pour strip 18, the rebar 24 extending out from the slab 12 is not directly connected to the rebar 28 extending out from the slab 14. That is, prior to the filling in of the gap 16 with the pour strip 18, the rebar 24 extending out from the slab 12 is not indirectly connected to the rebar 28 extending out from the slab 14. Other rebar (s) 30 is (are) positioned, or laid down, inside the gap 16 along the width direction, so that the other rebar(s) 30 is (are) perpendicular to the length direction of the rebar 24 and/or 28. Then, the pour strip 18 is formed around the rebar 24, 28, 30 filling in the gap 16.

Referring back to FIG. 1, in a multi-level building construction having one or more floors, the floor construction 10 can be placed above another floor. These floors are connected to and accessible via a construction elevator 30. Generally, there is only one (or very few) construction elevator 30 that is used during the construction of the building. Accordingly, during the construction of the floor construction 10, the slab 12 area can be accessed via the elevator 30. However, the slab 14 area cannot be accessed easily when a gap 16 four feet and more exists between the slabs 12, 14. That is, construction equipment cannot easily be moved to slab 14 from slab 12. Thus, generally, the construction process requiring access to slab 14 waits the twenty to thirty days until the pour strip 18 is poured to splice the slabs 12, 14 together. Further, the gap 16 allows significant weather conditions to intrude into the floor beneath the floor construction 10. Such weather conditions can also prevent work from being performed in the floor underneath the floor construction 10. Despite these disadvantages of having long gaps in post-tension concrete construction, waiting and time delay are generally an accepted part of the-process in the field of construction.

BRIEF SUMMARY

Devices, systems, and methods for connecting post-tensioned concrete slabs in new floor construction reduce the distance (e.g., length) of the gap between the post-tensioned concrete slabs as compared to conventional construction. Accordingly, the devices, systems, and methods disclosed herein advantageously reduce project construction time by reducing the time delay in accessing the floor underneath the slabs due to, for example, safety and/or weather conditions.

An embodiment of this concrete construction includes a first post-tensioned concrete slab, a second post-tensioned concrete slab, and a cavity-forming device. The first post-tensioned concrete slab and the second post-tensioned concrete slab have respective upper surfaces that are generally aligned. The first post-tensioned concrete slab includes a plurality of first rebars installed therein. The second post-tensioned concrete slab includes a plurality of second rebars installed therein. The first post-tensioned concrete slab and second post-tensioned concrete slab are separated by a gap so that the concrete material of the first post-tensioned concrete slab is not in contact with the concrete material of the second post-tensioned concrete slab. The cavity-forming device forms a cavity. The cavity-forming device is installed in the first post-tensioned concrete slab, wherein the cavity contains a portion of one of the second rebars.

In an embodiment of the concrete construction, the cavity-forming device has an end which is connected to an end portion of one of the first rebars, wherein the end has a threaded surface which mates with a threaded surface of the end portion of the one of the first rebars.

In an embodiment of the concrete construction, a portion of one of the first rebars is also contained in the cavity.

In an embodiment of the concrete construction, the cavity-forming device has a pair of tubes extending upwardly through the first post-tensioned concrete slab and providing air access from above the post-tensioned concrete slab to the cavity, the cavity being filled through one of the tubes with a binding material which fixes the one of the second rebars in the cavity.

In an embodiment of the concrete construction, the cavity-forming device has a pair of tubes extending upwardly through the first post-tensioned concrete slab and providing air access from above the post-tensioned concrete slab to the cavity, the cavity being filled through one of the tubes with a binding material which connects together the one of the first rebars and the one of the second rebars so that the portion of the one of the first rebars and the portion of the one of the second rebars are substantially parallel with each other.

In an embodiment of the concrete construction, the cavity-fomiing device has a pair of tubes extending upwardly through the first post-tensioned concrete slab and providing air access from above the post-tensioned concrete slab to the cavity, the cavity being filled with a binding material which connects together the one of the first rebars and the one of the second rebars so that the portion of the one of the first rebars and the portion of the one of the second rebars are substantially inline.

An embodiment of the concrete construction further comprises a second cavity formed by a second cavity-forming device installed in the second post-tensioned concrete slab, wherein the second cavity contains a portion of another of the plurality of the first rebars.

In an embodiment of the concrete construction, the gap has a longer dimension for one side-to-side and a shorter dimension for another side-to-side, the shorter dimension being three feet or less.

In an embodiment of the concrete construction, the gap has a longer dimension for one side-to-side and a shorter dimension for another side-to-side, the shorter dimension being twelve (12) inches or less. In some embodiments, the distance of the shorter dimension is from two to six inches. In some embodiments, the distance of the shorter dimension is from two to seven inches. In some embodiments, the distance of the shorter dimension is from two to eight inches. In some embodiments, the distance of the shorter dimension is from two to nine inches. In some embodiments, the distance of the shorter dimension is from two to ten inches. In some embodiments, the distance of the shorter dimension is from two to eleven inches. In some embodiments, the distance of the shorter dimension is from two to twelve inches.

An embodiment of the concrete construction further comprises a strip of non-shrink material being in the gap, wherein the strip has a compressive strength that is greater than or equal to the compressive strength of the concrete material of the first and second post-tensioned concrete slabs.

An embodiment of a concrete construction includes a first post-tensioned concrete slab, a second post-tensioned concrete slab, and a cavity-forming device, the first post-tensioned concrete slab and the second post-tensioned concrete slab having respective upper surfaces that are generally aligned, the first post-tensioned concrete slab including a plurality of first rebars installed therein, the second post-tensioned concrete slab including a plurality of second rebars installed therein, the first post-tensioned concrete slab and second post-tensioned concrete slab being separated by a gap so that the concrete material of the first post-tensioned concrete slab is not in contact with the concrete material of the second post-tensioned concrete slab, the cavity-forming device forming a cavity which together with the device form a volume, the cavity-forming device being installed in the first post-tensioned concrete slab, wherein one of the second rebars connects with the volume, the cavity being filled with a binding material which connects together the first post-tensioned concrete slab and the one of the second rebars, the gap having a longer dimension for one side-to-side and a shorter dimension for another side-to-side, the shorter dimension being twelve (12) inches or less, the gap being filled with a strip of non-shrink material, wherein the strip has a compressive strength that is greater than or equal to the compressive strength of the concrete material of the first and second post-tensioned concrete slabs.

In an embodiment of a method for making a concrete construction including a first post-tensioned concrete slab and a second post-tensioned concrete slab separated by a gap, the method includes the steps of forming the first post-tensioned concrete slab with a plurality of first rebars, wherein the first post-tensioned concrete slab includes a cavity-forming device with a cavity having an opening towards an end of the first post-tensioned concrete slab; prior to pouring a second concrete slab, positioning one of a plurality of second rebars for the second concrete slab so that a portion of the one of the plurality of second rebars is inside the cavity; pouring the second concrete slab; forming the second post-tensioned concrete slab by tensioning the second concrete slab, thus forming the gap between the first post-tensioned concrete slab and the second post-tensioned concrete slab, wherein the gap has a longer dimension for one side-to-side and a shorter dimension for another side-to-side; and after forming the second post-tensioned concrete slab, securely fixing the portion of the one of the plurality of the second rebars in the cavity.

An embodiment of the method, the step of securely fixing the portion of the second rebar in the cavity includes also securely fixing a portion of the first rebar in the cavity. In an embodiment of the method, the shorter dimension is three feet or less in length.

An embodiment of the method further comprises the step of forming a strip of material in the gap with a non-shrink material, wherein the strip has a compressive strength that is greater than or equal to the compressive strength of the concrete material of the first and second post-tensioned concrete slabs.

In an embodiment of a method for making a concrete construction including a first post-tensioned concrete slab and a second post-tensioned concrete slab separated by a gap, the method comprises the steps of forming the first post-tensioned concrete slab, wherein the first post-tensioned concrete slab includes a first rebar installed therein, and an end portion of the first rebar extends into a space that will become the gap; before a second post-tensioned concrete slab has been formed, positioning a cavity-forming device having a cavity at an end portion of the first rebar so that the end portion of the first rebar is inside the cavity, but not securely connecting the cavity-forming device to the end portion of the first rebar; pouring the second concrete slab; forming a second post-tensioned concrete slab by tensioning the second concrete slab, thus forming the gap between the first post-tensioned concrete slab and the second post-tensioned concrete slab, wherein the gap has a longer dimension for one side-to-side and a shorter dimension for another side-to-side; and after forming the second post-tensioned concrete slab, securely fixing the end portion of the first rebar in the cavity.

An embodiment of the method includes, prior to forming the second post-tensioned concrete slab, positioning a second rebar inside the cavity but not securely connecting the cavity-forming device to the second rebar; and in the securely fixing the portion of the first rebar in the cavity step, also securely fixing a portion of a second rebar of the second post-tensioned concrete slab in the cavity.

An embodiment of the method further includes the step of forming a strip of material in the gap with a non-shrink material, wherein the strip has a compressive strength that is greater than or equal to the compressive strength of the concrete material of the first and second post-tensioned concrete slabs.

DETAILED DESCRIPTION

Figure 1:
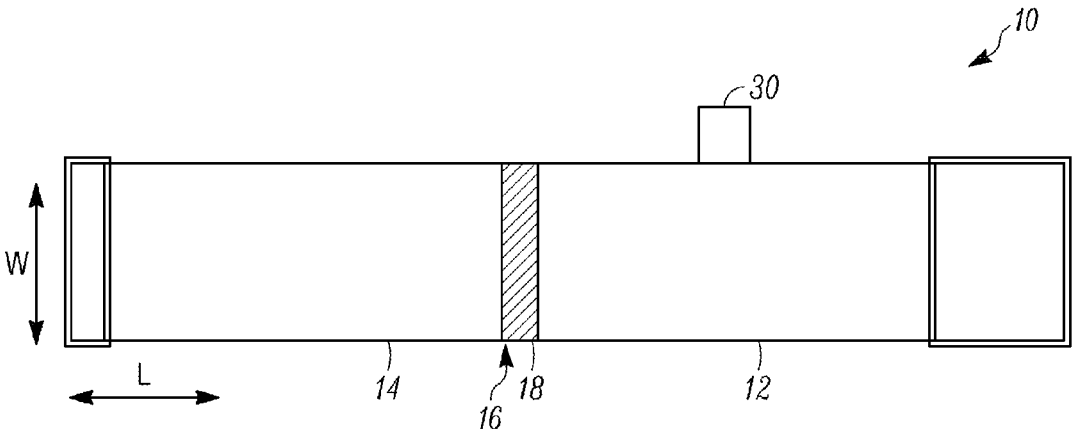
FIG. 1 (PRIOR ART)
FIGS. 1-2 show plan and elevation schematic diagrams, respectively, of a floor construction according to a generally known process using post-tensioned concrete.
Figure 2:
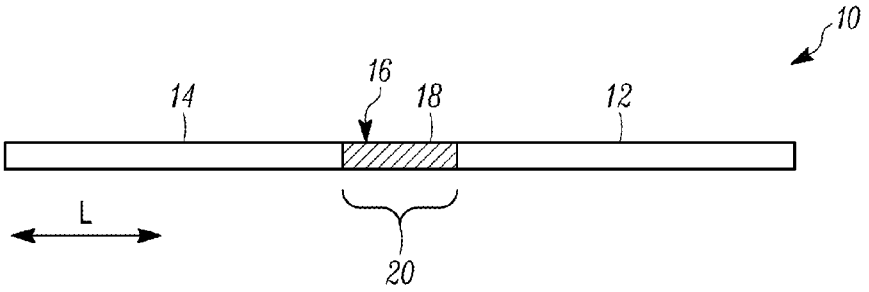
FIG. 2 (PRIOR ART)
Figure 3:
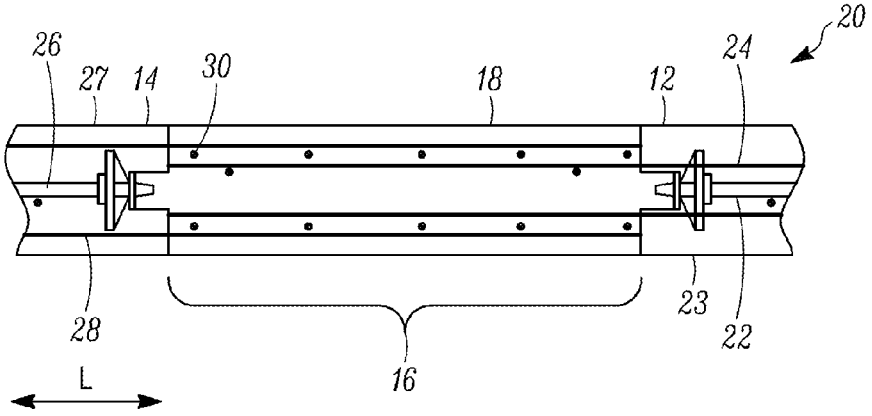
FIG. 3 (PRIOR ART)
FIG. 3 shows an enlarged, elevational schematic view of a portion of the floor construction shown in FIG. 2.

The present disclosure may be further understood with reference to the following description and the appended drawings, wherein like elements are referred to with the same reference numerals. The systems, devices, and methods disclosed herein are directed towards reducing the gap between post-tensioned concrete slabs in a floor construction, so that time delay caused by the existence of conventional gaps in the floor construction can be reduced and/or eliminated.

Figure 4:
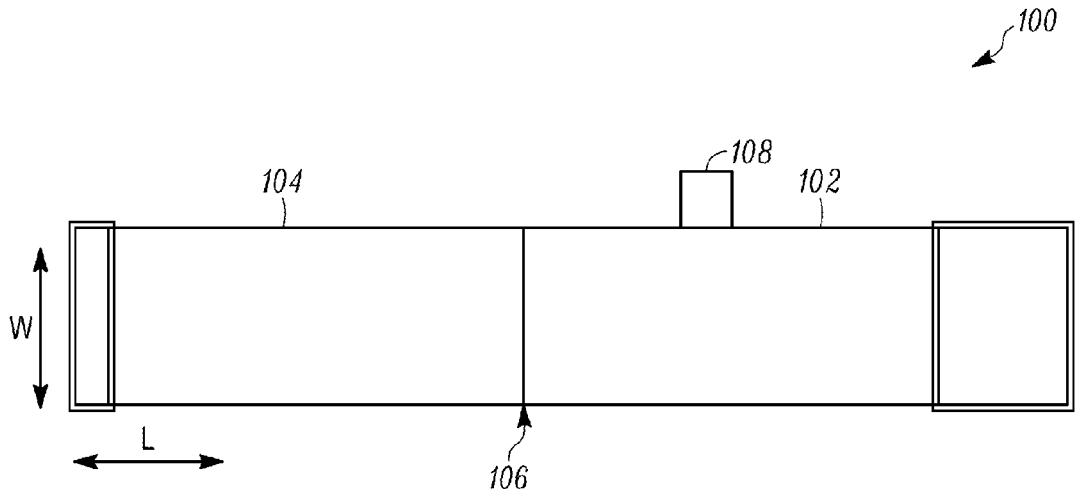
FIGS. 4-5 show plan and elevation schematic diagrams, respectively, of a floor construction according to an embodiment of the present invention.
Figure 5:
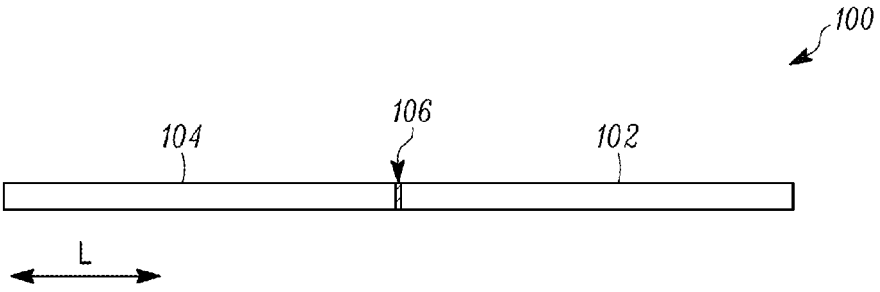

FIGS. 4-5 show schematic diagrams of a floor construction 100 according to an embodiment. FIG. 4 shows the "width" direction indicated by "W" and the "length" direction indicated by "L" (FIGS. 5-11 and 13-26 also show the length direction indicated by "L"). The floor construction 100 includes post-tensioned concrete slabs 102, 104. FIG. 4 shows a top-down plan view of the floor construction 100. The floor construction 100 includes post tensioned slabs 102, 104 separated by a gap 106. FIG. 5 shows a side view of the floor construction 100, also showing the slabs 102, 104, and the gap 106. The distance of the gap 106 is substantially less than the conventional gap. For example, it is possible that the gap 106 is less than three feet in distance. In a preferred embodiment, the gap 106 is a foot or less in distance.

Accordingly, the floor construction 100 can advantageously reduce the overall construction time of the construction project associated with the floor construction 100, because the time delay in accessing the floor underneath the floor construction 100 due to, for example, safety and/or weather conditions, is substantially reduced or eliminated. Further, in a multi-level building construction having one or more floors, the floor construction 100 can be placed above another floor. These floors are connected to and accessible via a construction elevator 108. Accordingly, during the construction of the floor construction 100, the slab 104 area can be accessed via the elevator 108 because the gap 106 has a distance that is small (or short) enough that the gap 106 can be crossed over, and/or the gap 106 can be covered with small piece of material such as, for example, a sheet of metal or a plank of wood, to serve as a short bridge between the slabs 102, 104. Accordingly, the construction equipment can be easily moved between slab 104 and slab 102. Thus, the generally required twenty to thirty day waiting period for accessing areas of the floor that cannot be reached due to the conventional gap (16 shown in FIG. 1) can be eliminated. In a multi-level building construction and/or very large building construction having large square footage floors, the reduction or elimination of the twenty to thirty day waiting period per gap compounds to an enormous reduction in the overall construction time required for the project.

Further, the gap 106 can substantially reduce or prevent weather conditions to intrude into the floor beneath the floor construction 100. Thus, weather conditions no longer prevent work from being performed in the floor underneath the floor construction 100. Therefore, waiting and time delay associated with weather conditions can be reduced or eliminated from the construction process.

Figure 6:
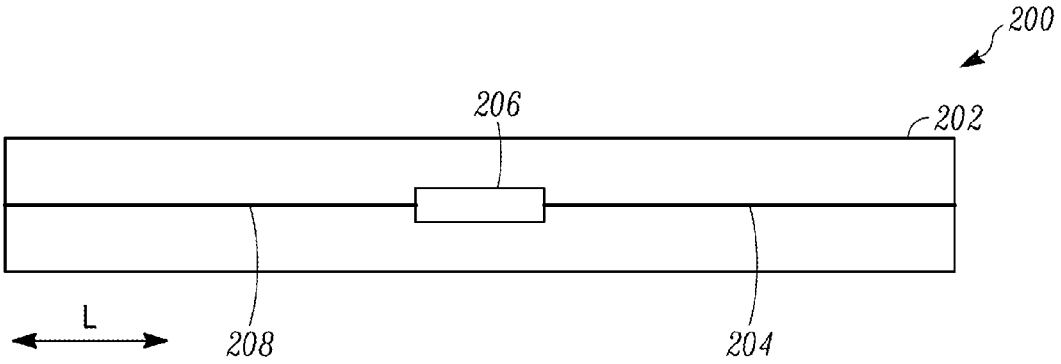
FIG. 6 shows a schematic side view of a floor construction according to an embodiment of the present invention.

FIG. 6 shows a schematic side view of a floor construction 200 according to an embodiment. The floor construction 200 includes a floor 202 formed by joining two post-tensioned concrete slabs with a pour strip filled into a gap between the two post-tensioned concrete slabs. The first post-tensioned concrete slab includes at least one rebar 204 that is connected to a cavity-forming device 206. Preferably, the cavity-forming device 206 is less than a foot in length. The second post-tensioned concrete slab includes another rebar 208 that is connected to the cavity-forming device 206. The rebars 204, 208 can be aligned substantially parallel with each other and/or aligned to be continuous along the length (axial) direction. Although not shown in the schematic view, it will be understood that the floor construction 200 can include a plurality of rebars in the first post-tensioned concrete slab, wherein each of the rebars is fixed with respect to cavity-forming devices. Further, a plurality of rebars in the second post-tensioned concrete slab are each fixed with respect to the respective cavity-forming device, so that each cavity-forming device fixes the rebar of the first post-tensioned concrete slab with respect to the rebar of the second post-tensioned concrete slab. After a grout (a binding material) is inserted into the cavities of the cavity forming devices to fix the respective rebars in the cavities, the cavity-forming devices provide structural integrity to the floor and becomes the force and/or tension transferring devices. That is, force and/or tension can be transferred through the cavity-forming devices to and/or from the rebars. Preferably, the grout is stronger than the concrete slab.

Figure 7:
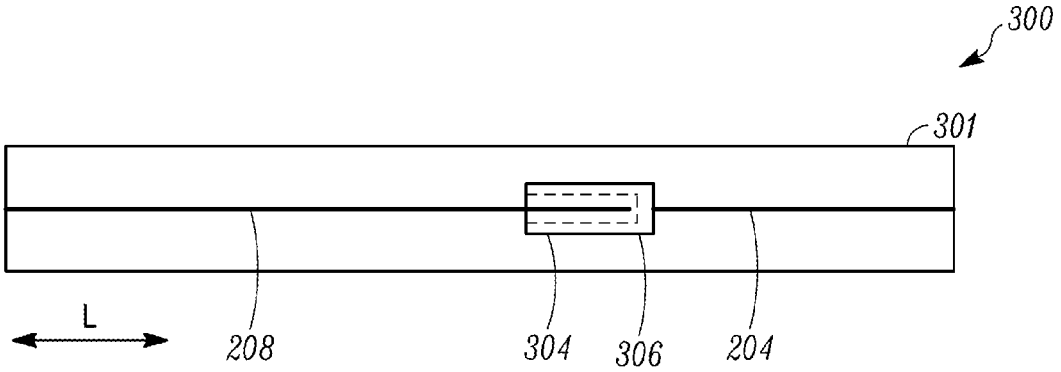
FIG. 7 shows a schematic side view of an embodiment of a floor construction according to an embodiment of the present invention.

FIG. 7 shows a schematic side view of an embodiment of a floor construction 300, which is similar to the floor construction 200 shown in FIG. 6. The floor construction 300 can include similar components as the floor construction 200 of FIG. 6. The floor construction 300 includes a floor 301 formed by joining two post-tensioned concrete slabs with a pour strip filled into a gap between the two post-tensioned concrete slabs. The first post-tensioned concrete slab includes at least one rebar 204 that is connected to a cavity-forming device 304 having a cavity 306. The second post-tensioned concrete slab includes another rebar 208 that is inserted into the cavity 306 of the cavity-forming device 304. During the process of forming the floor construction 300, the end portion of the second rebar 208 is allowed to move within the cavity 306 of the cavity-forming device 304 during the tensioning of the second slab. After the second post-tensioned concrete slab is formed, the cavity 306 of the cavity-forming device 304 is filled with, for example, grout material, to bind (e.g., fix and/or connect) the end portion of the second rebar 208 that is in the cavity 306 to the cavity-forming device 304. Accordingly, the cavity-forming device 304 becomes connected to both the first rebar 204 and the second rebar 208. The rebars 204, 208 can be aligned substantially parallel with each other and/or aligned to be continuous along the length (axial) direction. Although not shown in the schematic view, it will be understood that the floor construction 300 can include a plurality of rebars in the first post-tensioned concrete slab, wherein each of the rebars is connected to cavity-forming devices. Further, a plurality of rebars in the second post-tensioned concrete slab are each connected to the respective cavity-forming device, so that each cavity-forming device fixes the rebar of the first post-tensioned concrete slab with respect to the rebar of the second post-tensioned concrete slab. The force and/or tension can be transferred through the cavity-forming device 304 to and/or from the rebars 204, 208.

Figure 8:
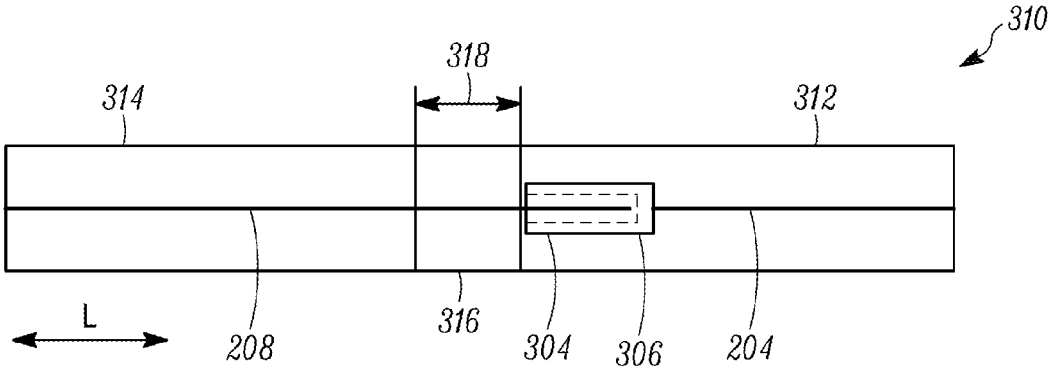
FIG. 8 shows a schematic side view of an embodiment of a floor construction according to an embodiment of the present invention.

FIG. 8 shows a schematic side view of an embodiment of a floor construction 310, which is similar to the floor construction 300 shown in FIG. 7. The floor construction 310 includes the first post-tensioned concrete slab 312 and the second post-tensioned concrete slab 314, and the pour strip 316 filled into the gap 318 that is between the two post-tensioned concrete slabs 312, 314. The first post-tensioned concrete slab 312 includes at least one rebar 204 that is connected to a cavity-forming device 304 having a cavity 306. The cavity-forming device 306 is positioned in the first post-tensioned concrete slab 312 so that the cavity 306 is provided as a part of the first post-tensioned concrete slab 312. The end portion of the second rebar 208 is positioned in the cavity 306 of the cavity-forming device 304.

During the process of forming the floor construction 310, the end portion of the second rebar 208 is allowed to move within the cavity 306 of the cavity-forming device 304 as the second post-tensioned concrete slab 314 is formed by tensioning of the concrete material. After the second post-tensioned concrete slab 314 is formed, the cavity 306 of the cavity-forming device 304 is filled with, for example, grout material to bind the end portion of the second rebar 208 that is in the cavity 306, and thus fixing the second rebar 208 with respect to the cavity-forming device 304.

Figure 9:
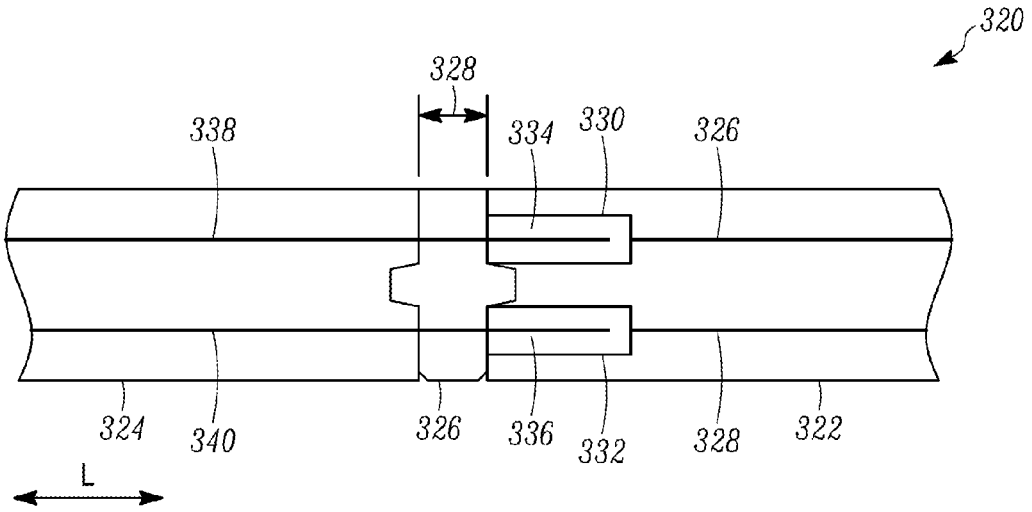
FIG. 9 shows a schematic side view of an embodiment of a floor construction according to an embodiment of the present invention.

FIG. 9 shows a schematic side view of an embodiment of a floor construction 320, which includes a first post-tensioned concrete slab 322 and a second post-tensioned concrete slab 324, and a pour strip 326 filled into a gap 328 that is between the two post-tensioned concrete slabs 322, 324. The first post-tensioned concrete slab 322 includes a plurality of rebars 326, 328 that are connected to respective cavity-forming devices 330, 332, wherein each of the cavity-forming devices 330, 332 has a cavity 334, 336. The cavity-forming devices 330, 332 are positioned in the first post-tensioned concrete slab 322 so that the cavities 334, 336 are provided as parts of the first post-tensioned concrete slab 322. End portions of a plurality of rebars 338, 340 of the second post-tensioned concrete slab 324 are positioned in the respective cavities 334, 336. During the process of forming the floor construction 320, the end portions of the rebars 338, 340 are allowed to move within the respective cavities 334, 336 as the second post-tensioned concrete slab 324 is formed by tensioning of the concrete material. After the second post-tensioned concrete slab 324 is formed, the cavities 334, 336 are each filled with, for example, grout material to bind the end portions of the rebars 338, 340 to the respective cavity-forming devices 330, 332.

Figure 10:
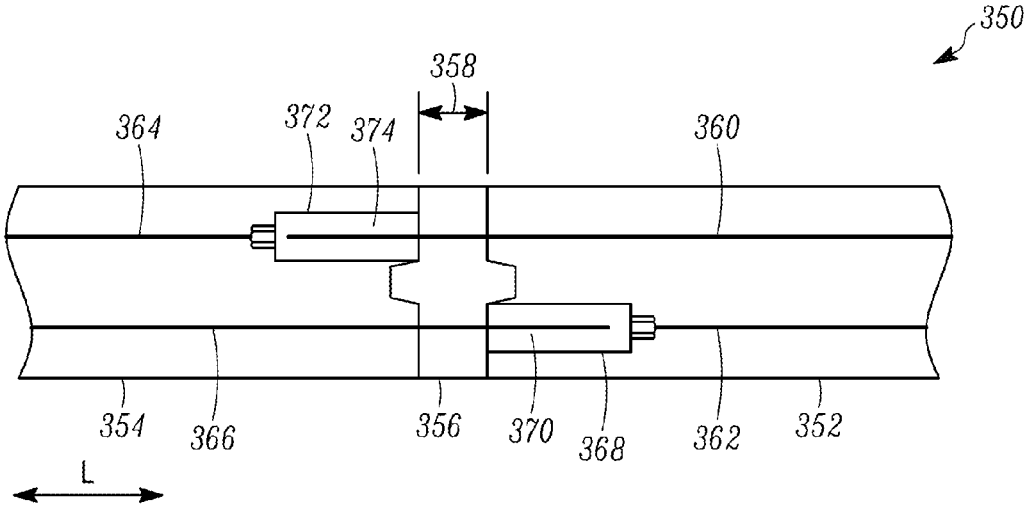
FIG. 10 shows a schematic side view of an embodiment of a floor construction according to an embodiment of the present invention.
Figure 11:
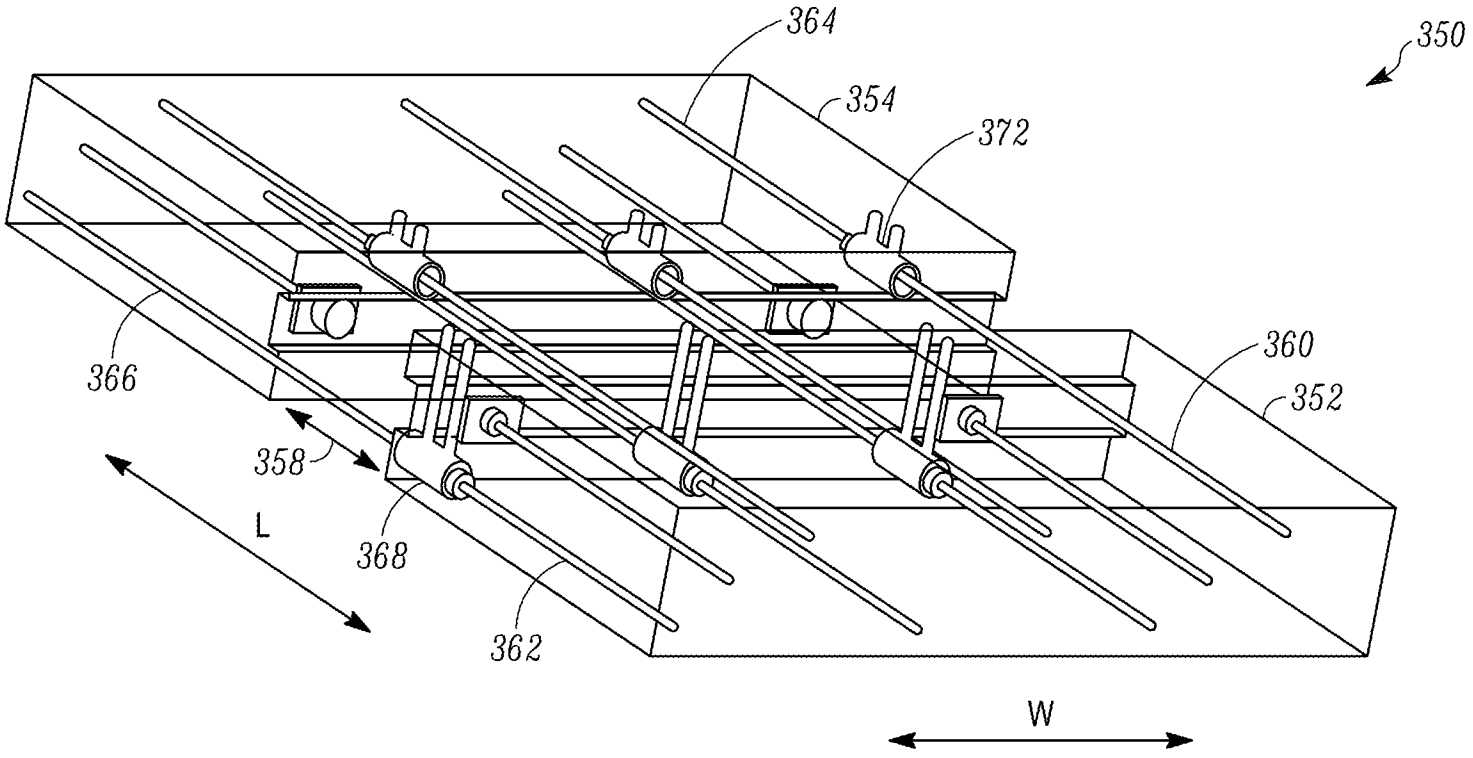
FIG. 11 shows a schematic perspective view of the floor construction shown in FIG. 10.

FIGS. 10 and 11 show an embodiment of a floor construction 350. FIG. 10 shows a schematic side view of the floor construction 350. FIG. 11 shows an enlarged schematic perspective view of the floor construction 350. The floor construction 350 includes a first post-tensioned concrete slab 352 and a second post-tensioned concrete slab 354, and a pour strip 356 filled into a gap 358 that is between the two post-tensioned concrete slabs 352, 354. FIG. 11 does not show the pour strip in the gap 358. The first post-tensioned concrete slab 352 includes a plurality of rebars 360, 362. The second post-tensioned concrete slab 354 includes a plurality of rebars 364, 366. At least one 362 of the rebars 360, 362 of the first post-tensioned concrete slab 352 is connected to a cavity-forming device 368 having a cavity 370, wherein the cavity-forming device 368 is positioned at least partly within the material of the first post-tensioned concrete slab 352. Preferably, the cavity-forming device 368 is positioned completely within the material of the first post-tensioned concrete slab 352. An end portion of the rebar 366 of the second post-tensioned concrete slab 354 is positioned within the cavity 370. During the process of forming the floor construction 350, the end portion of the rebar 366 is allowed to move within the cavity 370 as the second post-tensioned concrete slab 354 is formed by tensioning of the concrete material. After the second post-tensioned concrete slab 354 is formed, the cavity 370 is filled with, for example, grout material to bind the end portion of the rebar 366 to the cavity-forming device 368. Further, at least one 364 of the rebars 364, 366 of the second post-tensioned concrete slab 354 is connected to a cavity-forming device 372 having a cavity 374, wherein the cavity-forming device 372 is positioned at least partly within the material of the second post-tensioned concrete slab 354. Preferably, the cavity-forming device 372 is positioned completely within the material of the second post-tensioned concrete slab 354. An end portion of one of the rebars 360 of the first post-tensioned concrete slab 352 is positioned within the cavity 374. During the process of forming the floor construction 350, the cavity-forming device 372 is allowed to move as the second post-tensioned concrete slab 354 is formed by tensioning of the concrete material. Accordingly, while the end portion of the rebar 360 is contained in the cavity 374, during the tensioning of the concrete material in forming the second post-tensioned concrete slab 354, the volume change of the concrete material moves the cavity-forming device 372 with respect to the rebar 360. After the second post-tensioned concrete slab 354 is formed, the cavity 374 is filled with, for example, grout material to bind the end portion of the rebar 360 to the cavity-forming device 372.

Figure 12:
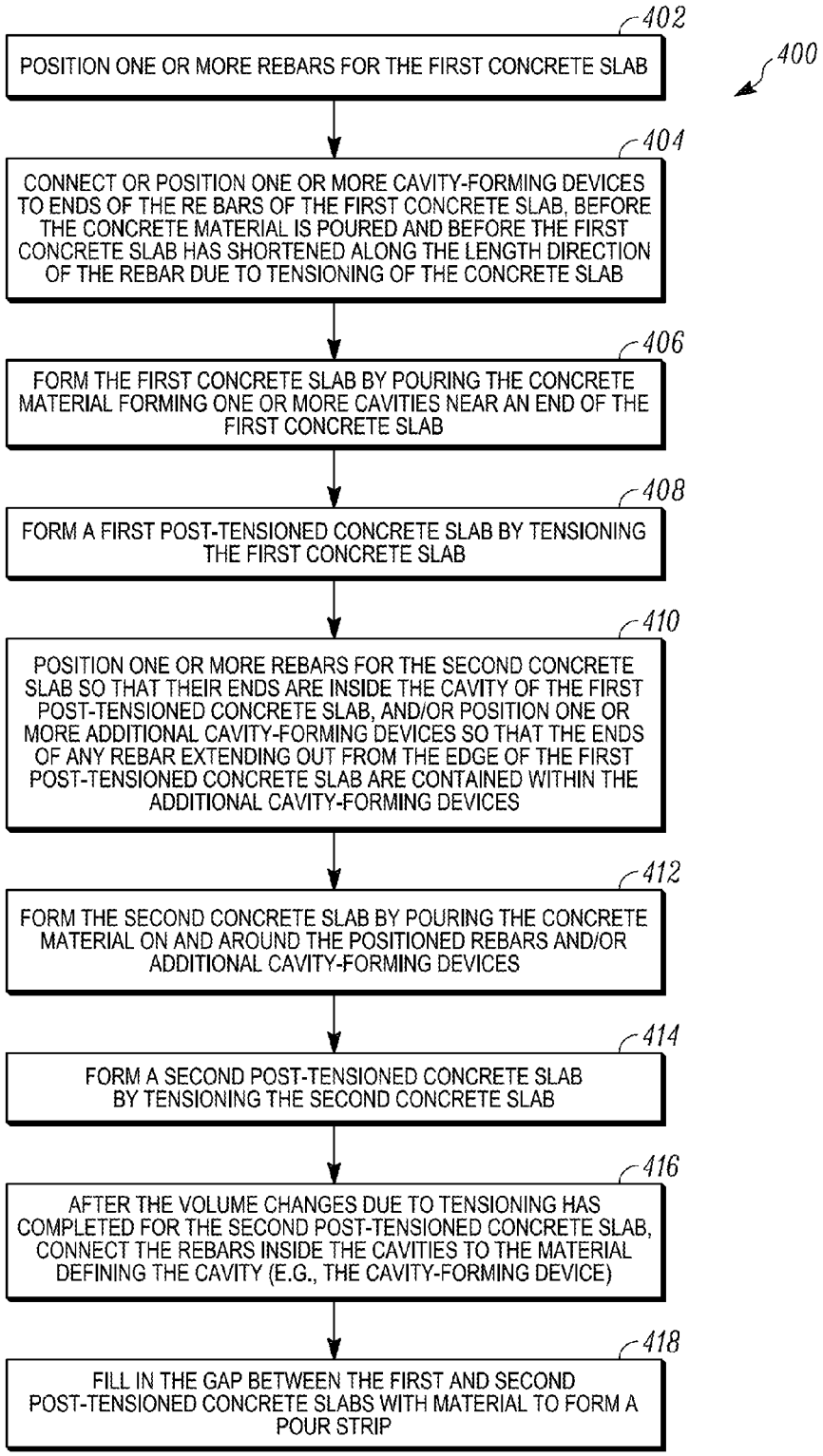
FIG. 12 shows a flow chart of an embodiment of a process for constructing the floor construction with reduced gap design.

FIG. 12 shows a flow chart of an embodiment of a process 400 for constructing the floor construction with reduced gap design. The process includes a step 402 of positioning one or more rebars for a first concrete slab, prior to pouring the concrete material. Then, in step 404, cavity-forming devices are positioned at near where an edge of the concrete slab would form. Preferably, the cavity-forming devices are splice devices connected to and/or positioned at ends of the rebars. If desired, the cavity-forming devices can be connected, attached, and/or secured on to the rebars of the first slab at this time. This particular step can depend on the particular features of the cavity-forming device used. The process 400 includes a step 406 of forming the first concrete slab, wherein the first concrete slab includes one or more rebars and one or more cavities (and cavity-forming devices and/or splice devices). Preferably, the cavities are elongated and generally cylindrical in shape. Further, the cavities are positioned near the end of the first concrete slab. It is preferable that the cavities are formed by and/or defined by one or more cavity-forming devices. It is preferable that the end portion and/or near the end of one or more rebars is connected to a respective cavity-forming device at or near an end portion of the cavity-forming device. It is possible that the end portion of one or more rebars is positioned inside the cavity that is defined by the cavity-forming device, but not yet directly connected to the cavity-forming device. Further, it is possible that the ends of one or more rebars are positioned to extend out from an edge of the first slab. It is preferable that these ends of the rebars do not extend more than six inches beyond the edge of the first slab. It is more preferable that these ends of the rebars do not extend more than two inches beyond the edge of the first slab. It is even more preferable that the ends of the rebars of the first concrete slab do not extend out from an edge of the first slab. The process 400 includes a step 408 of forming a first post-tensioned concrete slab by tensioning the concrete material of the first concrete slab. The process 400 further includes a step 410 of positioning the rebars for the second concrete slab so that their ends are positioned within respective cavities (e.g., inner chambers of the cavity-forming devices) of the first post-tensioned concrete slab. This step 410 is performed prior to pouring the concrete for the second concrete slab. These rebars are positioned so that they can move with respect to the cavities (e.g., cavity-forming devices, splice devices, and/or the edge of the first post-tensioned concrete slab). That is, for example, the rebars for the second concrete slab are not secured to the cavity-forming devices at this stage of the process. It is preferable that the positioning of the rebars for the second concrete slab with respect to the cavity-forming devices are done after the first concrete slab has been tensioned (e.g., using the wire strand system that is included in the concrete slab) and has gone through the volume change, becoming the first post-tensioned concrete slab. Thus, the positioning of the rebars for the second concrete slab can be done with a desired gap space in mind. That is, after the first post-tensioned concrete slab has formed, the length change along the length direction of the rebars would have been completed. Thus, the length of the gap can be estimated and/or substantially determined. It is preferable that this estimated and/or substantially determined gap distance is less than a foot. It is even more preferable that this gap distance is less than six inches. Further, at this stage in the process 400, the cavities are open to where the gap between the first and second concrete slabs will exist when the second concrete slab is formed. The process 400 includes a step 412 of pouring and forming the second concrete slab. The second concrete slab includes one or more rebars that have end portions positioned within the cavities of the first post-tensioned concrete slab and/or any additional cavity-forming devices that have been placed for forming additional cavities within the second concrete slab. The process 400 includes a step 414 of forming a second post-tensioned concrete slab by tensioning the concrete material of the second concrete slab. In step 414, the second concrete slab is shortened along the length direction of the rebar by and due to tensioning of a wire strand system in the second concrete slab. Because the rebars for the second concrete slab are not secured to the cavities of the first post-tensioned concrete slab, the rebars can and do move with respect to the cavities during the tensioning of the second concrete slab. Likewise, if there are any additional cavity-forming devices that have been positioned to be within the second concrete slab, and these cavities contain ends of the rebars of the first post-tensioned concrete slab, the additional cavities move with respect to the rebars contained therein during the tensioning and forming the second post-tensioned concrete slab. After the volume changes due to tensioning of the second concrete slab has been completed, the second concrete slab is the second post-tensioned concrete slab. The process 400 includes a step 416 of connecting and/or securing the rebars of the second post-tensioned concrete slab to the cavity-forming devices. In addition, if in the step 404 the cavity-forming device was not secured to the rebar of the first concrete slab, then, in step 416, the cavity-forming device can be secured to the first rebar of the first post-tensioned concrete slab. Accordingly, in the step 416, both of the first and second rebars of the first and second post-tensioned concrete slabs can be secured (e.g., fixed or connected) within the cavity of the cavity-forming device (e.g., this particular step can depend on the particular features of the cavity-forming device used). At this stage in the process 400, the gap between the first post-tensioned concrete slab and the second post-tensioned concrete slab is generally fixed. Accordingly, the gap distance is generally known. The gap distance of three feet or less is possible. Preferably, the gap distance at this stage is one foot or less. Even more preferably, the gap distance is less than a foot. The process 400 includes a step 418 of filling in the gap between the first and second post-tensioned concrete slabs with material to form a pour strip. When the pour strip is formed in the gap, the cavity-forming devices connected to the rebars of the first and second post-tensioned concrete slabs are covered by the pour strip. It is preferable that the cavity-forming devices positioned in the gap are completely covered by the pour strip.

FIGS. 13-18 show schematic side views of floor constructions 500*a-f*, respectfully, being constructed according to the process 400 described above and shown in FIG. 12. Like elements are referred to with the same reference numerals. The floor constructions 500*a-f* show cavity-forming devices 502, 504 having the same features. Each of the cavity-forming devices 502, 504 has a generally cylindrical shape. In some embodiments, the cavity-forming device has an elongated shape with a geometric base (e.g., circle, oval, ovoid, triangle, square, rectangular, hexagon, octagon, etc.). The body 506 of the cavity-forming device 502 defines a cavity 508, and the body 506 has an opening 510 at one of the ends that allows access to the cavity by a rebar (530 shown in FIGS. 15-18). The cavity 508 is configured to allow the rebar (530 shown in FIGS. 15-18) to move with respect to the cavity 508 and/or the splice device 502 during tensioning of a concrete slab which includes the rebar (530 shown in FIGS. 15-18). The body 506 also has another end 512 opposite from the opening 510 along the length direction of the body 506. The end 512 includes a connector 514 configured for connecting and securing to an end of a rebar 522. For example, the connector 514 can be a threaded chamber, wherein the inner side surface of the connector 514 is threaded to mate with matching threads of the rebar. Accordingly, the rebar 522 that is used to connect at the end 512 of the cavity-forming device 502 requires matching threads at the surface of the rebar 522. The cavity-forming device 502 includes grout material for connecting the rebars 522, 530. The cavity 508 can be accessed (e.g., for filling in the cavity with the grout material in order to secure a portion of the rebar to the cavity-forming device) via an inlet 516. The splice device 502 can also include an outlet 518, wherein the air in the cavity 508 can be evacuated out via the outlet 518 during the filling of the cavity 508 with the grout material. Additionally and/or alternatively, the air in the cavity 508 can be evacuated out via the opening 510 during the filling of the cavity 508 with the grout material. After the grout material fills in the cavity 508, the rebars 522, 530 are connected or fixed securely via the cavity-forming device 502.

Figure 13:
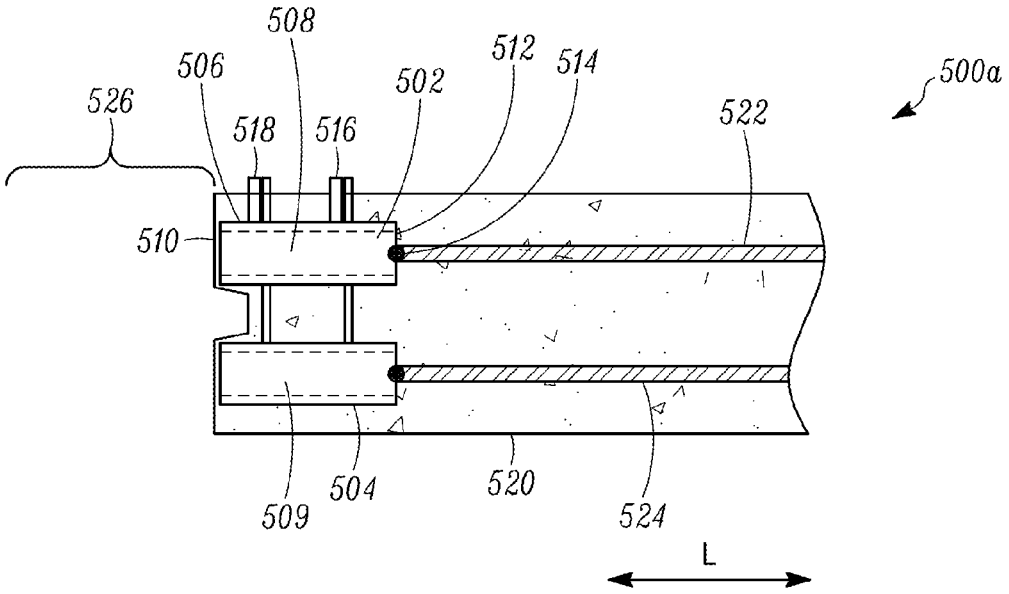
FIGS. 13-18 show schematic side views of floor constructions being constructed according to an embodiment of the process.

FIG. 13 shows the floor construction 500*a*, wherein a first concrete slab 520 is formed with rebars 522, 524 therein (see steps 402 and 404 in the process 400 of FIG. 12). End portions of the rebars 522, 524 are connected to respective cavity-forming devices 502, 504. It is possible that the cavity-forming devices 502, 504 are positioned to not extend beyond the end of the first concrete slab 520 and into a location 526 where a gap will exist when a second concrete slab is formed. Optionally, the opening 510 can be covered with a sheath during the pouring of the concrete material when the first concrete slab 520 is being formed to prevent the concrete material from entering into the cavity 508. Further, the inlet 516 and the outlet 518 can have elongated tubes to extend towards and out from the surface of the first concrete slab 520 to prevent the concrete material from entering into the cavity 508.

Figure 14:
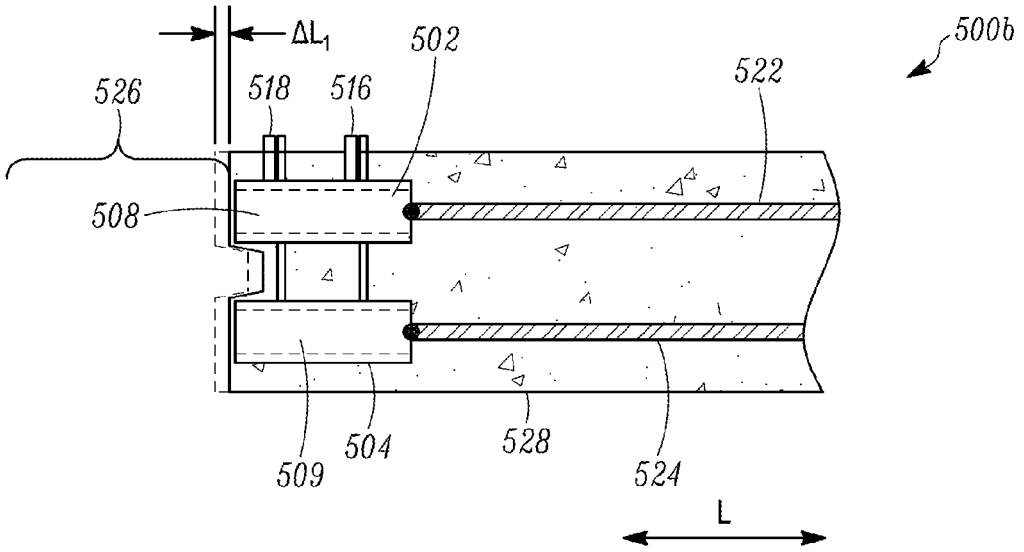

FIG. 14 shows the floor construction 500*b*, wherein the first concrete slab (520 shown in FIG. 13) has been tensioned and has become a first post-tensioned concrete slab 528. The volume of the first post-tensioned concrete slab 528 has changed from the volume of the first concrete slab 520, and a length of the first concrete slab 520 along the length direction of the rebars 522, 524 has been reduced by the tensioning, indicated by $\Delta L_1$ (see step 406 in the process 400 of FIG. 12). Accordingly, the first post-tensioned concrete slab 528 includes cavities 508, 509 for receiving and containing ends of the rebars (530, 532 shown in FIGS. 15-18) of the second concrete slab.

Figure 15:
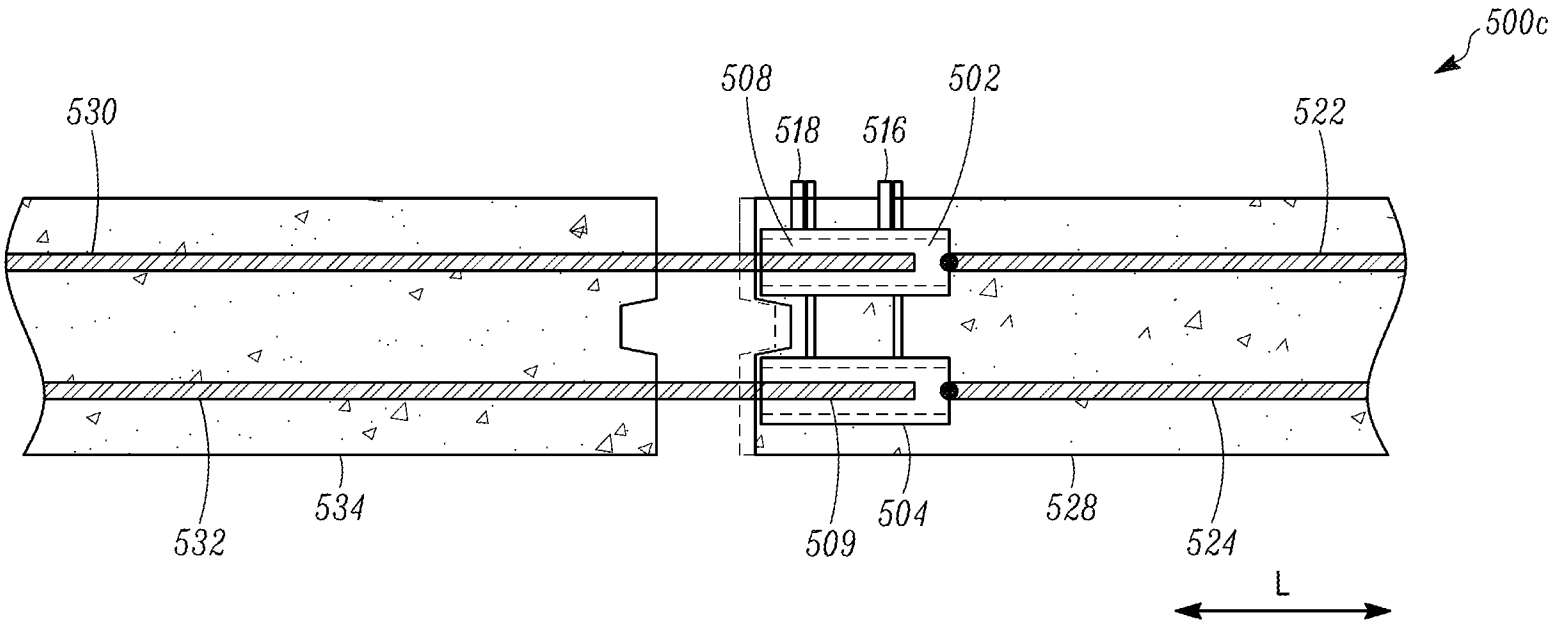

FIG. 15 shows the floor construction 500*c*, wherein additional rebars 530, 532 of the second concrete slab 534 are positioned so that each of the rebars 530, 532 has an end portion inside the respective cavities 508, 509 of the first post-tensioned concrete slab 528 (see step 410 in the process 400 of FIG. 12). The rebars 530, 532 can be aligned in a length direction of the rebars 522, 528 guided by the cavity-forming devices 502, 504. The second concrete slab 534 is poured to include the rebars 530, 532 (see step 412 in the process 400 of FIG. 12). Because the cavities 508, 509 in the first post-tensioned concrete slab 528 accommodate the ends of the rebars 530, 532 and allow the rebars 530, 532 to move during the tensioning of the second concrete slab 534, the edge of the second concrete slab 534 can be positioned closer to the edge of the first post-tensioned concrete slab 528 than conventional floor constructions. For example, it is possible that the distance from the edge of the second concrete slab 534 to the edge of the first post-tensioned concrete slab 528 is three feet or less. Preferably, the distance from the edge of the second concrete slab 534 to the edge of the first post-tensioned concrete slab 528 is one foot or less.

Figure 16:
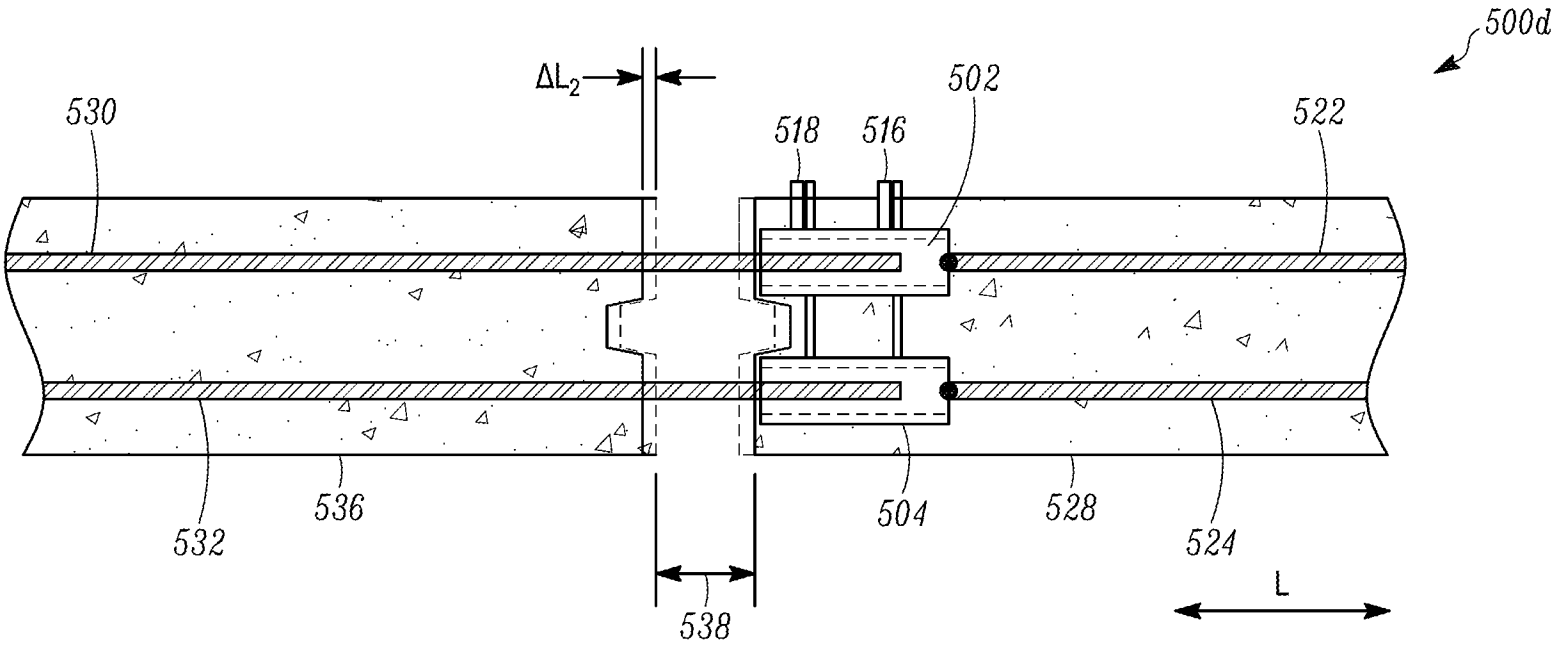
Figure 17:
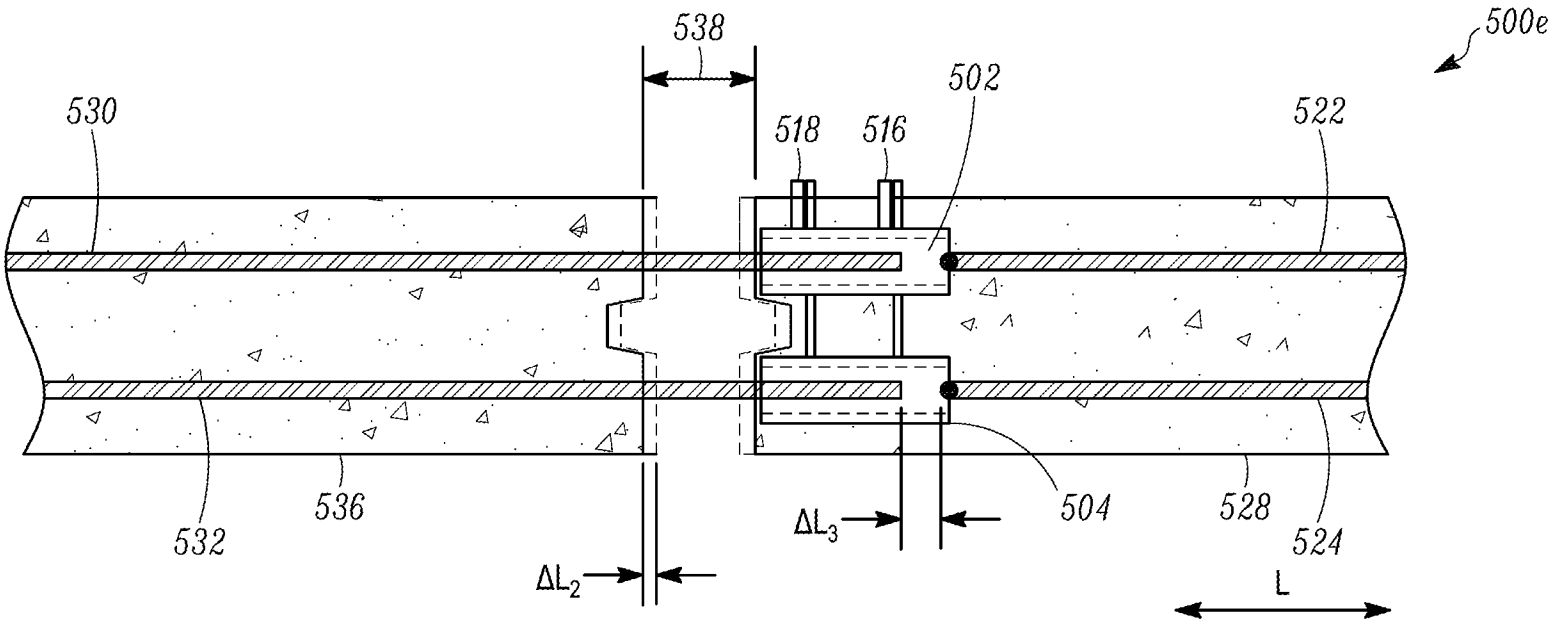

FIG. 16 shows the floor construction 500*d*, wherein the second concrete slab (534 shown in FIG. 15) has been tensioned and has become a second post-tensioned concrete slab 536 (see step 414 in the process 400 of FIG. 12). Thus, the volume of the second post-tensioned concrete slab 536 has changed from the volume of the second concrete slab 534, and a length of the second concrete slab 534 along the length direction of the rebars 530, 532 has been reduced by the tensioning, indicated by $\Delta L_2$. Where the gap 538 now exists, it is possible that the gap 538 is three feet or less. Preferably, the gap 538 is one foot or less. The cavity-forming devices 502, 504 are not yet secured to the rebars 530, 532. Thus, during the change in volume and length of the second concrete slab, the rebars 530, 532 are allowed to move with respect to the cavities 508, 509 and/or the cavity-forming device 502, 504. For example, shown in FIG. 17, as the length of the second concrete slab is reduced in the floor construction 500*e*, thus lengthening the location between the first post-tensioned concrete slab 528 and the second concrete slab to form the gap 538, the rebars 530, 532 may move (e.g., slide) away from the respective cavity-forming devices 502, 504 in the direction of the length change indicated by $\Delta L_3$. In embodiments, $\Delta L_2$ is equal to, the same as, or substantially similar to $\Delta L_3$. The length change $\Delta L_3$ does not move the end portion of the rebars 530, 532 so much that the length change $\Delta L_3$ prevents the rebars 530, 532 from being connected and/or secured to the respective cavity-forming devices 502, 504. This prevention is predetermined in the positioning of the rebars 530, 532, for example, in step 410 in the process 400 of FIG. 12, and/or structural features included in the cavity-forming devices 502, 504. After the volume change due to tensioning has been completed and the second post-tensioned concrete slab 536 has formed, the gap 538 between the first post-tensioned concrete slab 528 and the second post-tensioned concrete slab 536 is substantially defined.

Figure 18:
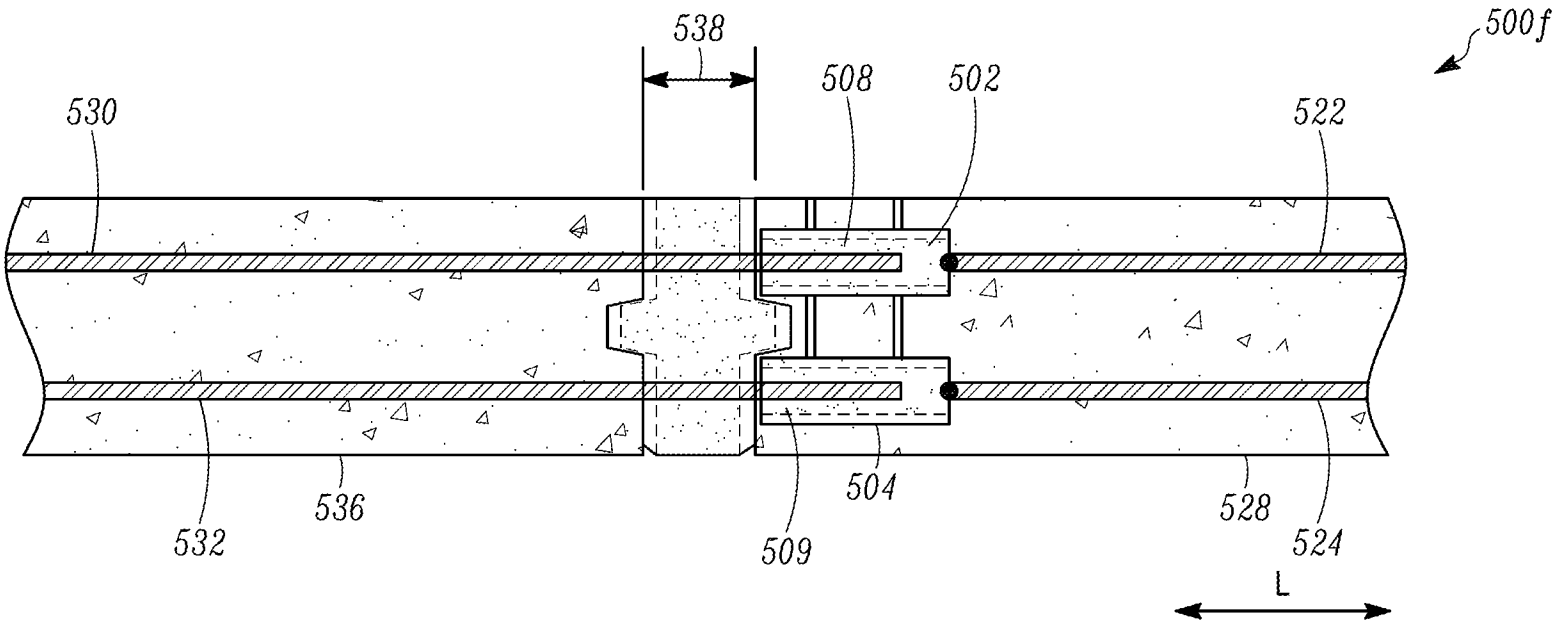

FIG. 18 shows the floor construction 500*f*, wherein the cavity-forming devices 502, 504 have been securely connected to the end portions of the respective rebars 530, 532 (see step 416 in the process 400 of FIG. 12). The connection can be accomplished by filling the cavities 508, 509 of each of the cavity-forming devices 502, 504 with grout material for securely binding the end portions of the respective rebars 530, 532 to the cavity-forming devices 502, 504. The floor construction 500*f* is positioned substantially horizontal with respect to the earth, and the floor construction 500*f* includes the first post-tensioned concrete slab 528 and the second post-tensioned concrete slab 536 separated by the gap 538. The cavity-forming devices 502, 504 are secured to the respective rebars 522, 524, 530, 532 with sufficient strength for structural applicability for connecting the two post-tensioned concrete slabs 528, 536 for structural purposes. The gap 538 has been filled in with a material to form a pour strip 540 (see step 418 in the process 400 of FIG. 12). The pour strip 540 covers the gap 538 sufficiently for structural purposes. Preferably, the gap 538 (e.g., edge to edge between the slabs 528, 536) is completely covered by the pour strip 526.

Figure 19:
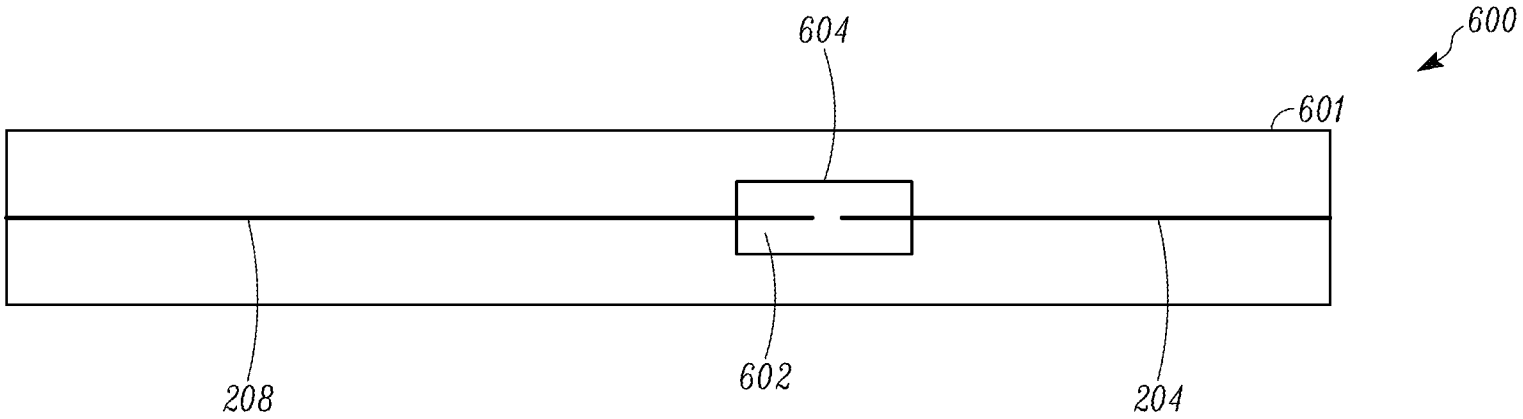
FIG. 19 shows a schematic side view of an embodiment of a floor construction according to an embodiment of the present invention.

FIG. 19 shows a schematic side view of an embodiment of a floor construction 600. The floor construction 600 can include similar components as the floor construction 200 of FIG. 6 and/or the floor construction 300 of FIG. 7. The floor construction 600 includes a floor 601 formed by joining two post-tensioned concrete slabs with a pour strip filled into a gap between the two post-tensioned concrete slabs. The first post-tensioned concrete slab includes at least one rebar 204 that is inserted into a cavity 602 of a cavity-forming device 604. The second post-tensioned concrete slab includes another rebar 208 that is inserted into the cavity 602 of the cavity-forming device 604. During the process of forming the floor construction 600, the end portion of the second rebar 208 is allowed to move within the cavity 602 during the tensioning of the second slab. After the second post-tensioned concrete slab is formed, the cavity 602 is filled with, for example, grout material, to bind the end portions of the first and second rebars 204, 208 that are in the cavity 602 of the cavity-forming device 604. Accordingly, the cavity-forming device 604 becomes fixed or connected to both the first rebar 204 and the second rebar 208. The rebars 204, 208 can be aligned substantially parallel with each other and/or aligned to be continuous along the length (axial) direction. Although not shown in the schematic view, it will be understood that the floor construction 600 can include a plurality of rebars in the first post-tensioned concrete slab, wherein each of the rebars is fixed with respect to cavity-forming devices. Further, a plurality of rebars in the second post-tensioned concrete slab are each fixed or connected with respect to the respective cavity-forming device, so that each cavity-forming device connects the rebar of the first post-tensioned concrete slab with respect to the rebar of the second post-tensioned concrete slab.

Figure 20:
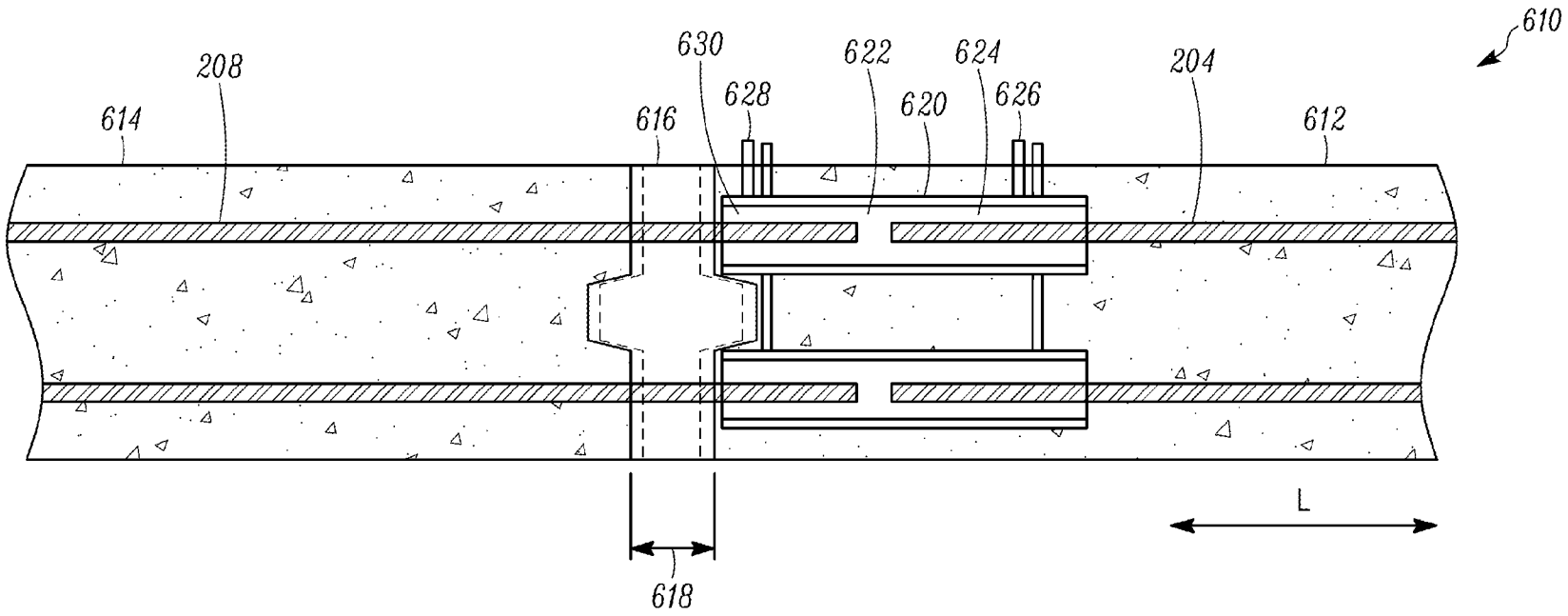
FIG. 20 shows a schematic side view of an embodiment of a floor construction according to an embodiment of the present invention.

FIG. 20 shows a schematic side view of an embodiment of a floor construction 610, which is similar to the floor construction 600 shown in FIG. 19. The floor construction 610 includes the first post-tensioned concrete slab 612 and the second post-tensioned concrete slab 614, and the pour strip 616 filled into the gap 618 that is between the two post-tensioned concrete slabs 612, 614. The first post-tensioned concrete slab 612 includes at least one cavity-forming device 620 having a cavity 622. Accordingly, the cavity-forming device 620 forms the cavity 622 in the first post-tensioned concrete slab 612 having an opening 630 towards the gap 618. The end portions of the first and second rebars 204, 208 are positioned in the cavity 622. During the process of forming the floor construction 610, the end portion of the second rebar 208 is allowed to move within the cavity 622 as the second post-tensioned concrete slab 614 is formed by tensioning of the concrete material. After the second post-tensioned concrete slab 614 is formed, the cavity 622 is filled with, for example, grout material 624, to bind the end portions of the first and second rebars 204, 208 that are in the cavity 622 to the cavity-forming device 620. The cavity-forming device 620 includes an inlet 626 for directing the grout material into the cavity 622, and an outlet 628 for directing flow of air and other fluids and particles to aid in the grout material from entering and filling up the cavity 622. Optionally, the cavity-forming device 620 may include a lid at an opening 630 of the cavity for preventing cement material or other materials from entering into the cavity 622 when such prevention is needed and/or desired. For example, when pouring the concrete materials around the rebar 204, it may be desirable to prevent the concrete materials from entering into the cavity 622. The lid can be placed at the opening 630 to prevent the concrete materials from entering into the cavity 622. Further, the inlet 626 and the outlet 628 can be configured to have an elongated tube shape having a height that is sufficient to extend to a top surface of the concrete slab 612. The force and/or tension in the floor construction 610 can be transferred through the cavity-forming device 620 to and/or from the rebars 204, 208.

Figure 21:
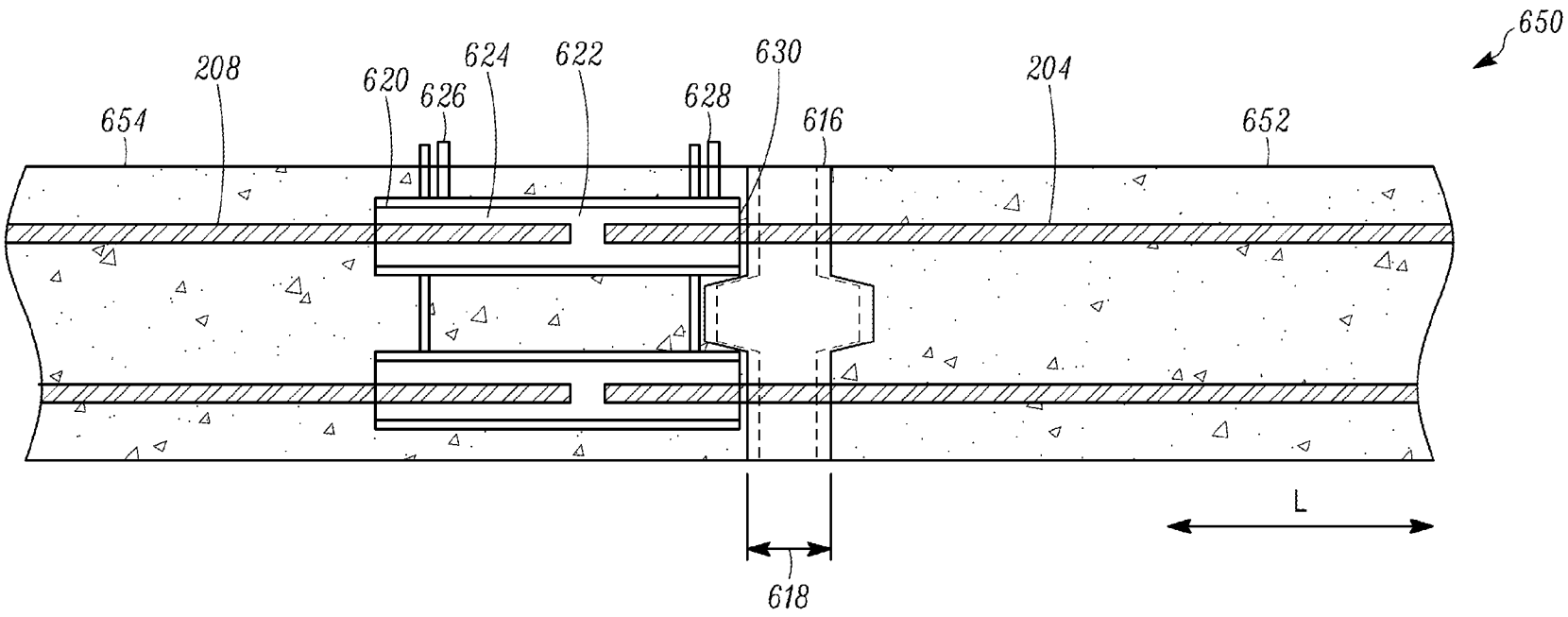
FIG. 21 shows a schematic side view of an embodiment of a floor construction according to an embodiment of the present invention.

FIG. 21 shows a schematic side view of an embodiment of a floor construction 650, which is similar to the floor construction 600 shown in FIG. 19. The floor construction 650 includes the first post-tensioned concrete slab 652 and the second post-tensioned concrete slab 654, and the pour strip 616 filled into the gap 618 that is between the two post-tensioned concrete slabs 652, 654. The second post-tensioned concrete slab 654 includes at least one cavity-forming device 620 having a cavity 622. Accordingly, the cavity-forming device 620 forms the cavity 622 in the second post-tensioned concrete slab 654 having an opening 630 towards the gap 618. The end portions of the first and second rebars 204, 208 are positioned in the cavity 622. During the process of forming the floor construction 610, the end portion of the second rebar 208 is allowed to move within the cavity 622 as the second post-tensioned concrete slab 614 is formed by tensioning of the concrete material. After the second post-tensioned concrete slab 614 is formed, the cavity 622 is filled with, for example, grout material 624, to bind the end portions of the first and second rebars 204, 208 that are in the cavity 622 to the cavity-forming device 620. The cavity-forming device 620 includes an inlet 626 for directing the grout material into the cavity 622, and an outlet 628 for directing flow of air and other fluids and particles to aid in the grout material from entering and filling up the cavity 622. Optionally, the cavity-forming device 620 may include a lid at an opening 630 of the cavity for preventing cement material or other materials from entering into the cavity 622 when such prevention is needed and/or desired. For example, when pouring the concrete materials around the rebar 208, it may be desirable to prevent the concrete materials from entering into the cavity 622. The lid can be placed at the opening 630 to prevent the concrete materials from entering into the cavity 622. Further, the inlet 626 and the outlet 628 can be configured to have an elongated tube shape having a height that is sufficient to extend to a top surface of the concrete slab 654. An embodiment of a floor construction includes both the configuration shown in FIGS. 20 and 21.

Figure 22:
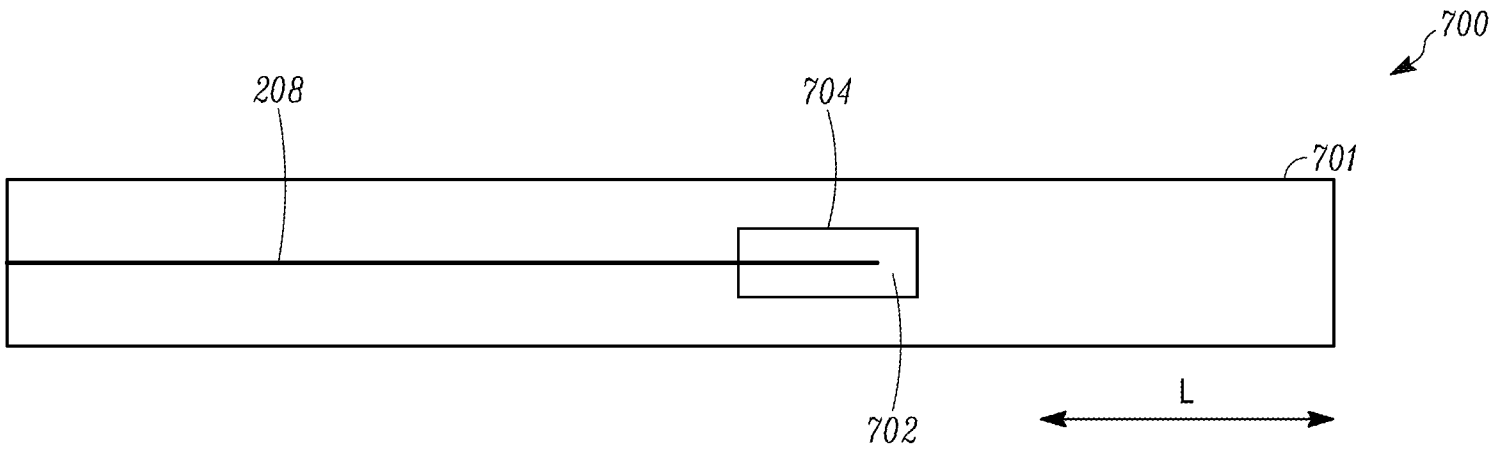
FIG. 22 shows a schematic side view of an embodiment of a floor construction according to an embodiment of the present invention.

FIG. 22 shows a schematic side view of an embodiment of a floor construction 700. The floor construction 700 can include similar components as the floor construction 200 of FIG. 6, the floor construction 300 of FIG. 7, and/or the floor construction 600 of FIG. 19. The floor construction 700 includes a floor 701 formed by joining two post-tensioned concrete slabs with a pour strip filled into a gap between the two post-tensioned concrete slabs. At least one of the post-tensioned concrete slabs includes at least one rebar 708 that is inserted into a cavity 702 of a cavity-forming device 704. During the process of forming the floor construction 700, the end portion of the rebar 708 is allowed to move within the cavity 702 during the tensioning of the associated concrete slab. After the post-tensioned concrete slab is formed, the cavity 702 is filled with, for example, grout material, to bind the end portions of the rebar 708 that is in the cavity 702 to the cavity-forming device 704. Accordingly, the cavity-forming device 704 becomes connected to the rebar 708. Although not shown in the schematic view, it will be understood that the floor construction 700 can include a plurality of rebars in the first post-tensioned concrete slab, wherein each of the rebars can be connected to cavity-forming devices. Further, a plurality of rebars in the second post-tensioned concrete slab can be connected to the respective cavity-forming device.

Figure 23:
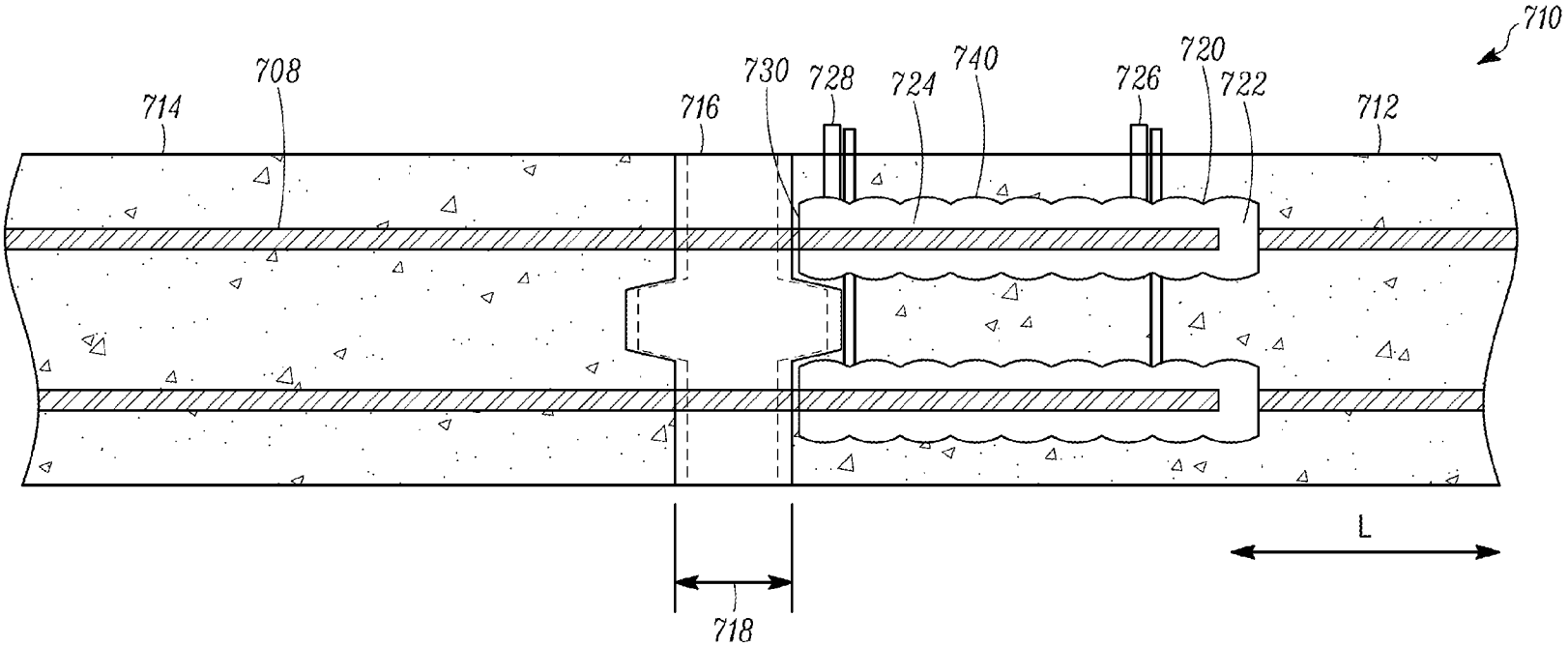
FIG. 23 shows a schematic side view of an embodiment of a floor construction according to an embodiment of the present invention.

FIG. 23 shows a schematic side view of an embodiment of a floor construction 710, which is similar to the floor construction 700 shown in FIG. 22. The floor construction 710 includes the first post-tensioned concrete slab 712 and the second post-tensioned concrete slab 714, and the pour strip 716 filled into the gap 718 that is between the two post-tensioned concrete slabs 712, 714. The first post-tensioned concrete slab 712 includes at least one cavity-forming device 720 having a cavity 722. Accordingly, the cavity-forming device 720 forms the cavity 722 in the first post-tensioned concrete slab 712 having an opening 730 towards the gap 718. The cavity-forming device 720 can include a corrugated outer surface 740 that increases a surface area of the cavity-forming device 720. The increased surface area of the outer surface 740 can advantageously increase areas of contact between the cavity-forming device 720 and the concrete material of the concrete slab, and can enhance the structural strength in this region of the floor construction. Further, the corrugated material making up the cavity-forming device 720 can be made from corrugated metal sheets, which can significantly reduce cost. The end portion of the rebar 708 of the second post-tensioned concrete slab 714 is positioned in the cavity 722. During the process of forming the floor construction 710, the end portion of the rebar 708 is allowed to move within the cavity 722 as the second post-tensioned concrete slab 714 is formed by tensioning of the concrete material. After the second post-tensioned concrete slab 714 is formed, the cavity 722 is filled with, for example, grout material 724, to bind the end portion of the rebar 708 in the cavity 722 to the cavity-forming device 720. The cavity-forming device 720 includes an inlet 726 for directing the grout material into the cavity 722, and an outlet 728 for directing flow of air and other fluids and particles to aid in the grout material from entering and filling up the cavity 722. Optionally, the cavity-forming device 720 may include a lid at the opening 730 of the cavity 722 for preventing cement material or other materials from entering into the cavity 722 when such prevention is needed and/or desired. For example, when pouring the concrete materials around the cavity-forming device 720, it may be desirable to prevent the concrete materials from entering into the cavity 722. The lid can be placed at the opening 730 to prevent the concrete materials from entering into the cavity 722. Further, the inlet 726 and the outlet 728 can be configured to have an elongated tube shape having a height that is sufficient to extend to a top surface of the concrete slab 712.

Figure 24:
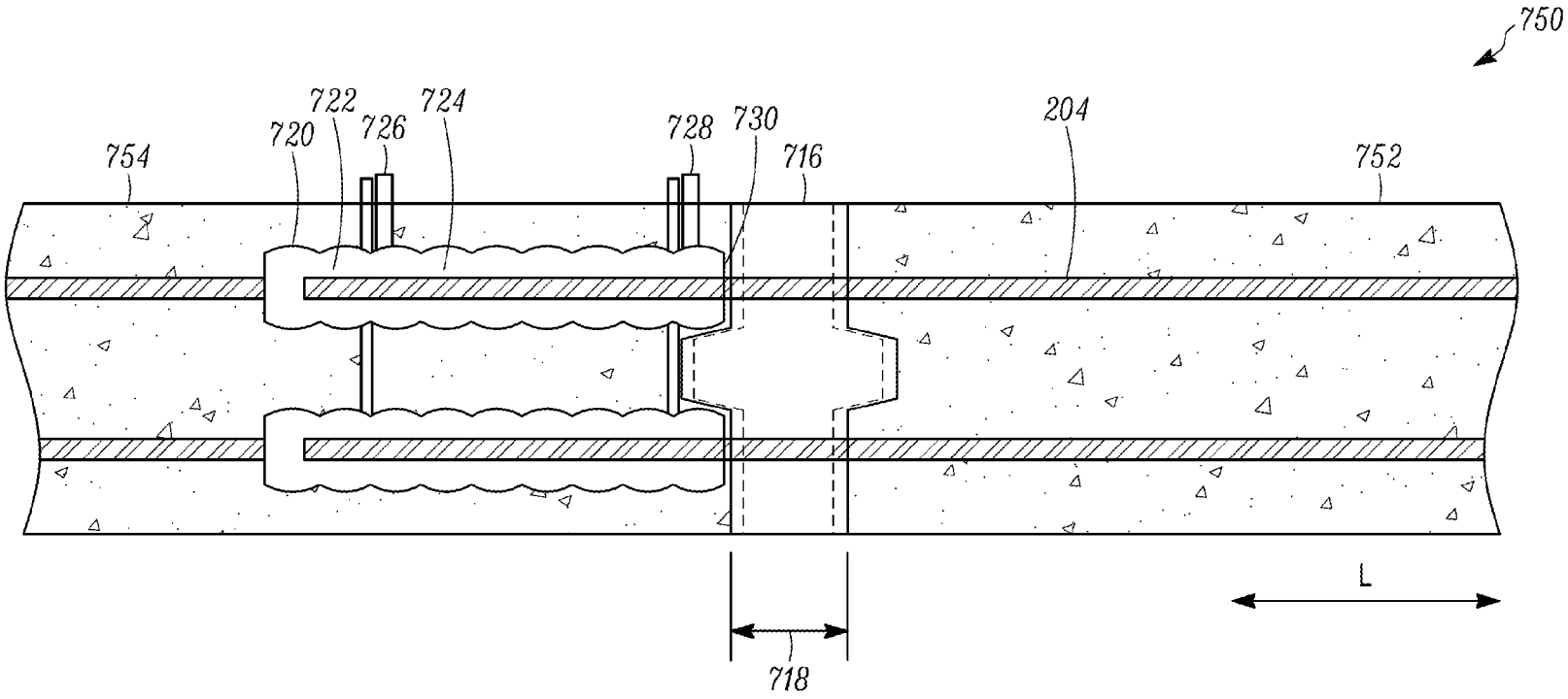
FIG. 24 shows a schematic plan view of an embodiment of a floor construction according to an embodiment of the present invention.

FIG. 24 shows a schematic side view of an embodiment of a floor construction 750, which is similar to the floor construction 700 shown in FIG. 22. The floor construction 750 includes the first post-tensioned concrete slab 752 and the second post-tensioned concrete slab 754, and the pour strip 716 filled into the gap 718 that is between the two post-tensioned concrete slabs 752, 754. The second post-tensioned concrete slab 754 includes at least one cavity-forming device 720 having a cavity 722. Accordingly, the cavity-forming device 720 forms the cavity 722 in the second post-tensioned concrete slab 754 having an opening 730 towards the gap 718. The end portion of the rebar 204 of the first post-tensioned concrete slab 752 is positioned in the cavity 722. During the process of forming the floor construction 710, the cavity-forming device 720 is allowed to move with respect to the end portion of the rebar 204 that is inside the cavity 722 as the second post-tensioned concrete slab 714 is formed by tensioning of the concrete material. After the second post-tensioned concrete slab 714 is formed, the cavity 722 is filled with, for example, grout material 724, to bind the end portion of the rebar 204 that is inside the cavity 722 of the cavity-forming device 720. The cavity-forming device 720 includes an inlet 726 for directing the grout material into the cavity 722, and an outlet 728 for directing flow of air and other fluids and particles to aid in the grout material from entering and filling up the cavity 722. Optionally, the cavity-forming device 720 may include a lid at an opening 730 of the cavity for preventing cement material or other materials from entering into the cavity 722 when such prevention is needed and/or desired. For example, when pouring the concrete materials around the cavity-forming device 720, it may be desirable to prevent the concrete materials from entering into the cavity 722. The lid can be placed at the opening 730 to prevent the concrete materials from entering into the cavity 722. Further, the inlet 726 and the outlet 728 can be configured to have an elongated tube shape having a height that is sufficient to extend to a top surface of the concrete slab 754. An embodiment of a floor construction includes both the configuration shown in FIGS. 23 and 24.

Figure 25:
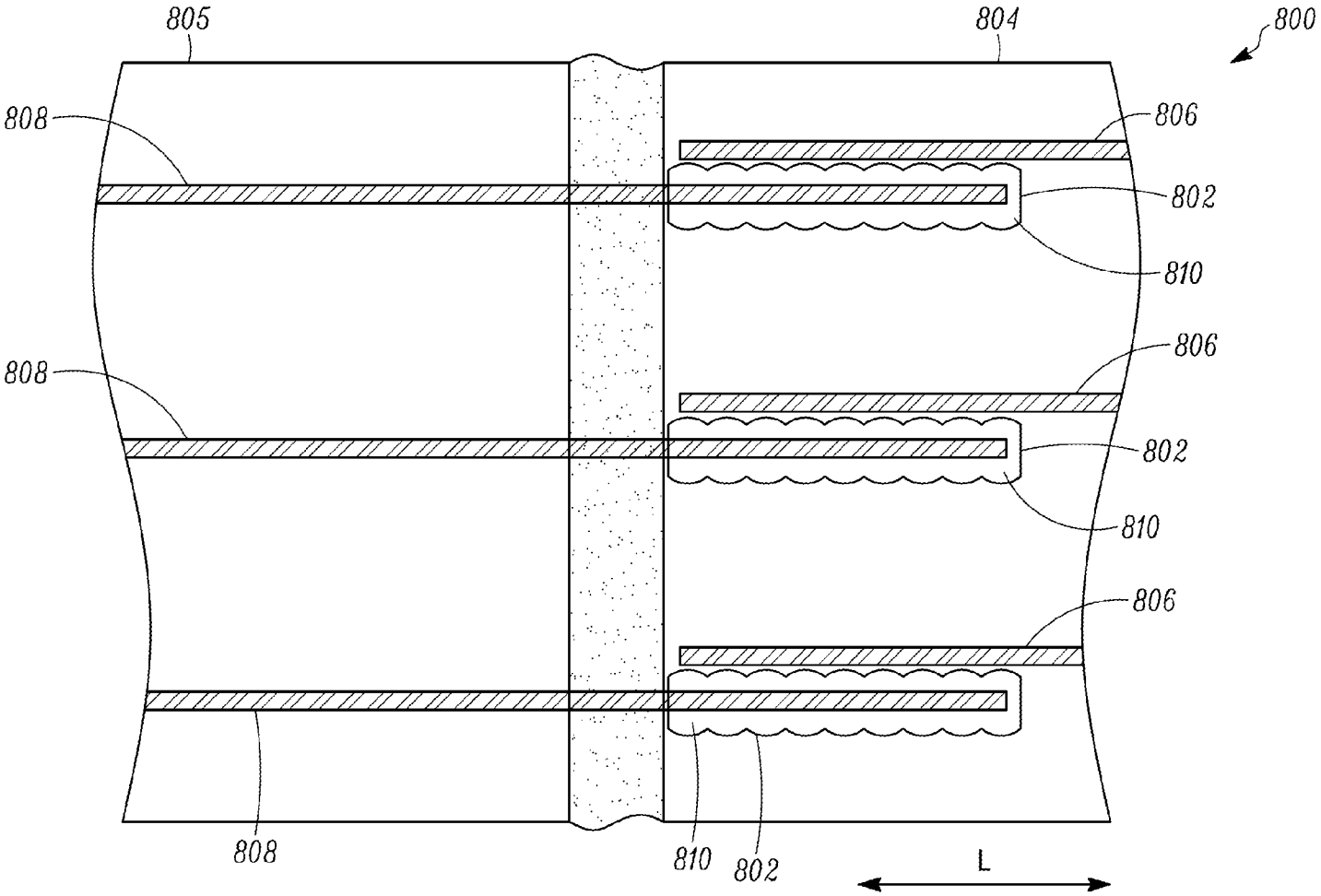
FIG. 25 shows a schematic plan view of an embodiment of a floor construction according to an embodiment of the present invention.

FIG. 25 shows a top-down plan view of an embodiment of the floor construction 800, wherein the floor construction 800 has all of the cavity-forming devices 802 in one of the first or second post-tensioned concrete slabs 804, 805. The cavity-forming devices 802 can be the same as the cavity-forming device (720 shown in FIGS. 23 and 24) described above. It is possible that the rebars 806 of one of the post-tensioned slabs are not directly connected to the cavity-forming devices 802. Nevertheless, the rebars 806 of one of the post-tensioned slabs are fixed in the slabs relative to the cavity-forming devices 802. The rebars 808 have end portions that are contained within the respective cavities 810 of the cavity-forming devices 802.

Figure 26:
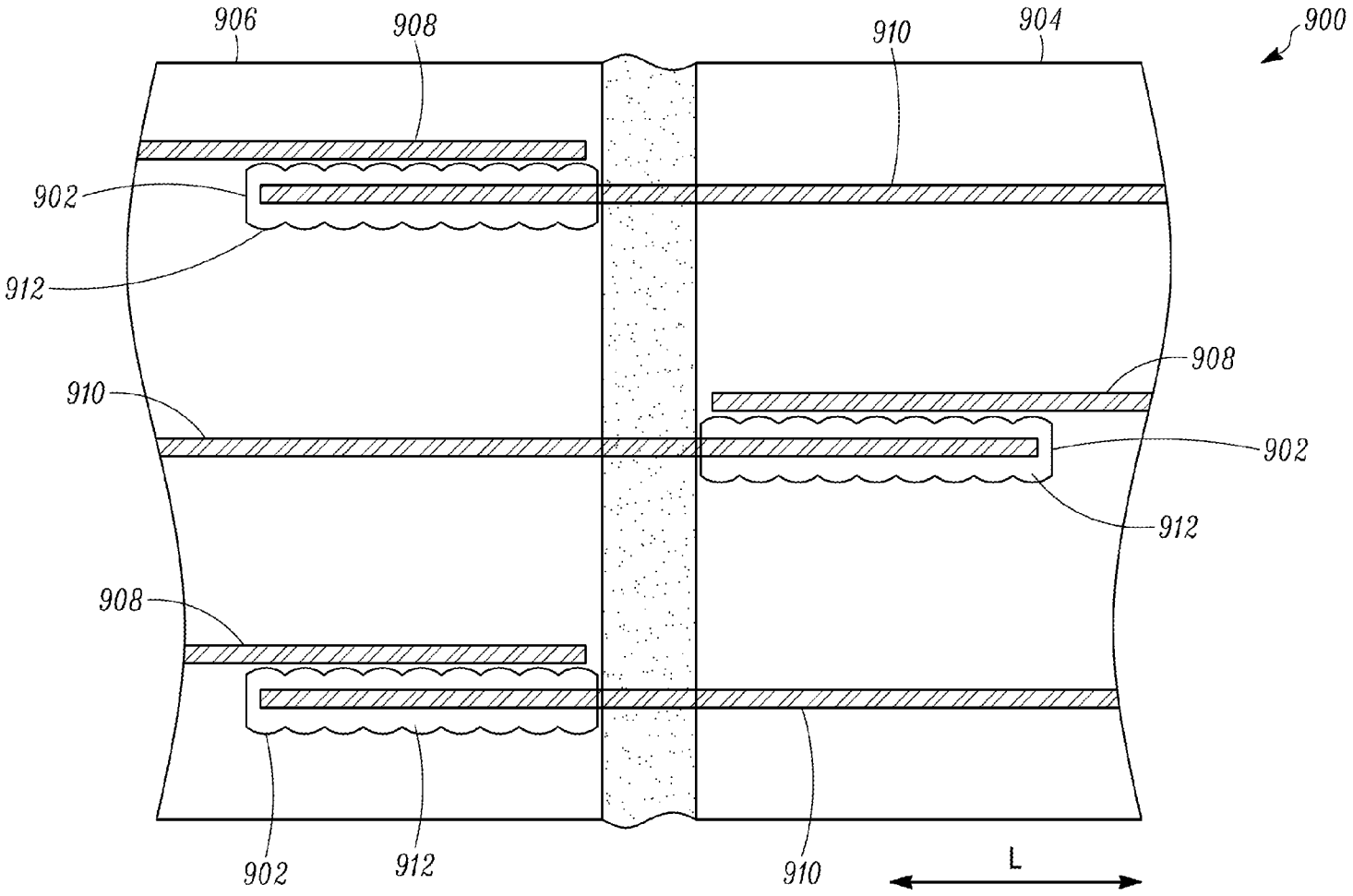
FIG. 26 shows a schematic plan view of an embodiment of a floor construction according to an embodiment of the present invention.

FIG. 26 shows a top-down plan view of an embodiment of the floor construction 900, wherein the floor construction 900 has the cavity-forming devices 902 in both of the first or second post-tensioned concrete slabs 904, 906. The cavity-forming devices 902 can be the same as the cavity-forming device (720 shown in FIGS. 23 and 24) described above. It is possible that the rebars 908 of one of the post-tensioned slabs are not directly connected but are fixed in the slabs relative to the cavity-forming devices 902. It is also possible that the rebars 908 of one of the post-tensioned slabs 904 are connected to the cavity-forming devices 902. The rebars 910 have end portions that are contained within the respective cavities 912 of the cavity-forming devices 902.

Applications of the embodiments disclosed herein include all aspects of construction, including, but not limited to, buildings, towers, floating terminals, ocean structures and ships, storage tanks, nuclear containing vessels, bridge piers, bridge ducts, foundation soil anchorages, and virtually all other types of installations where normally reinforced concrete may be acceptable.

Preferred embodiments have been described. Those skilled in the art will appreciate various modifications and substitutions are possible, without departing from the scope of the invention as claimed and disclosed, including the full scope of equivalents thereof.

What is claimed is:

1. A concrete floor construction, comprising:

a first post-tensioned concrete floor slab, a second post-tensioned concrete floor slab, and a cavity-forming device, said first post-tensioned concrete floor slab and said second post-tensioned concrete floor slab having respective upper surfaces that are generally aligned, said first post-tensioned concrete floor slab including a plurality of first rebars installed therein, said first post-tensioned concrete slab being post-tensioned in at least a direction substantially parallel to said plurality of first rebars, said second post-tensioned concrete floor slab including a plurality of second rebars installed therein, said second post-tensioned concrete slab being post-tensioned in at least a direction substantially parallel to said plurality of second rebars, said first post-tensioned concrete floor slab and said second post-tensioned concrete floor slab being separated by a gap so that the concrete material of said first post-tensioned concrete floor slab is not in contact with the concrete material of said second post-tensioned concrete floor slab, and said cavity-forming device forming a cavity, said cavity-forming device being installed in said first post-tensioned concrete floor slab, wherein said cavity contains a portion of one of said second rebars.

2. The concrete floor construction according to claim 1, wherein said cavity-forming device has an end which is connected to an end portion of one of said first rebars, wherein said end has a threaded surface which mates with a threaded surface of said end portion of the one of said first rebars.

3. The concrete floor construction according to claim 1, wherein a portion of one of said first rebars is also contained in said cavity.

4. The concrete floor construction according to claim 3, wherein said cavity-forming device has a pair of tubes extending upwardly through said first post-tensioned concrete floor slab and providing air access from above said post-tensioned concrete floor slab to said cavity, said cavity being filled through one of said tubes with a binding material which connects together said one of said first rebars and said one of said second rebars so that the portion of said one of said first rebars and the portion of said one of said second rebars are substantially parallel with each other.

5. The concrete floor construction according to claim 3, wherein said cavity-forming device has a pair of tubes extending upwardly through said first post-tensioned concrete floor slab and providing air access from above said post-tensioned concrete floor slab to said cavity, said cavity being filled with a binding material which connects together said one of said first rebars and said one of said second rebars so that the portion of said one of said first rebars and the portion of said one of said second rebars are substantially inline.

6. The concrete floor construction according to claim 1, wherein said cavity-forming device has a pair of tubes extending upwardly through said first post-tensioned concrete floor slab and providing air access from above said post-tensioned concrete floor slab to said cavity, said cavity being filled through one of said tubes with a binding material which fixes said one of said second rebars in said cavity.

7. The concrete floor construction according to claim 1, further comprising a second cavity foimed by a second cavity-forming device installed in said second post-tensioned concrete floor slab, wherein said second cavity contains a portion of one of said plurality of said first rebars.

8. The concrete floor construction according to claim 1, wherein said gap has a longer dimension for one side-to-side and a shorter dimension for another side-to-side, said shorter dimension being three feet or less and being shorter relative to said longer dimension.

9. The concrete floor construction according to claim 1, wherein said gap has a longer dimension for one side-to-side and a shorter dimension for another side-to-side, said shorter dimension being twelve (12) inches or less and being shorter relative to said longer dimension.

10. The concrete floor construction according to claim 1, further comprising:

a strip of non-shrink material being in the gap, wherein said strip has a compressive strength that is greater than or equal to a compressive strength of the concrete material of said first and second post-tensioned concrete floor slabs.

11. A concrete construction, comprising:

a first post-tensioned concrete slab, a second post-tensioned concrete slab, and a cavity-forming device, said first post-tensioned concrete slab and said second post-tensioned concrete slab having respective upper surfaces that are generally aligned, said first post-tensioned concrete slab including a plurality of first rebars installed therein, said first post-tensioned concrete slab being post-tensioned in at least a direction substantially parallel to said plurality of first rebars, said second post-tensioned concrete slab including a plurality of second rebars installed therein, said second post-tensioned concrete slab being post-tensioned in at least a direction substantially parallel to said plurality of second rebars, said first post-tensioned concrete slab and said second post-tensioned concrete slab being separated by a gap so that the concrete material of said first post-tensioned concrete slab is not in contact with the concrete material of said second post-tensioned concrete slab, said cavity-forming device forming a cavity, said cavity-forming device being installed in said first post-tensioned concrete slab, wherein said cavity contains a portion of one of said plurality of second rebars, and said cavity-forming device is not directly connected to said plurality of first rebars.

12. The concrete construction according to claim 11, wherein said one of said first rebars and the portion of said one of said second rebars are substantially parallel with each other.

13. A concrete floor construction, comprising:

a first post-tensioned concrete floor slab, a second post-tensioned concrete floor slab, and a cavity-forming device, said first post-tensioned concrete floor slab and said second post-tensioned concrete floor slab having respective upper surfaces that are generally aligned, said first post-tensioned concrete floor slab including a plurality of first rebars installed therein, said first post-tensioned concrete floor slab being post-tensioned in at least a direction substantially parallel to said plurality of first rebars, said second post-tensioned concrete floor slab including a plurality of second rebars installed therein, said second post-tensioned concrete floor slab being post-tensioned in at least a direction substantially parallel to said plurality of second rebars, said first post-tensioned concrete floor slab and said second post-tensioned concrete floor slab being separated by a gap so that the concrete material of said first post-tensioned concrete floor slab is not in contact with the concrete material of said second post-tensioned concrete floor slab, said cavity-forming device forming a cavity which together with said device form a volume, said cavity-forming device being installed in said first post-tensioned concrete floor slab, wherein one of said second rebars connects with said volume, said cavity being filled with a binding material which connects together said first post-tensioned concrete floor slab and said one of said second rebars, said gap having a longer dimension for one side-to-side and a shorter dimension for another side-to-side, said shorter dimension being twelve (12) inches or less and being shorter relative to said longer dimension, and said gap being filled with a strip of non-shrink material, wherein said strip has a compressive strength that is greater than or equal to a compressive strength of the concrete material of said first and second post-tensioned concrete floor slabs.

14. A method for making a concrete floor construction including a first post-tensioned concrete floor slab and a second post-tensioned concrete floor slab separated by a gap, comprising:

forming said first post-tensioned concrete floor slab with a plurality of first rebars, said first post-tensioned concrete floor slab being post-tensioned in at least a direction substantially parallel to said plurality of first rebars, wherein said first post-tensioned concrete floor slab includes a cavity-forming device with a cavity having an opening towards an end of said first post-tensioned concrete floor slab;

prior to pouring a second concrete floor slab, positioning one of a plurality of second rebars for said second concrete floor slab so that a portion of said one of said plurality of second rebars is inside said cavity;

pouring said second concrete floor slab;

forming the second post-tensioned concrete floor slab by tensioning said second concrete floor slab in at least a direction substantially parallel to said plurality of second rebars, thus forming said gap between said first post-tensioned concrete floor slab and said second post-tensioned concrete floor slab, wherein said gap has a longer dimension for one side-to-side and a shorter dimension for another side-to-side, said shorter dimension being shorter relative to said longer dimension; and after forming said second post-tensioned concrete floor slab, securely fixing said portion of said one of said plurality of said second rebars in the cavity.

15. The method according to claim 14, in said step of securely fixing said portion of said second rebar in the cavity, also securely fixing a portion of said first rebar in the cavity.

16. The method according to claim 14, wherein said shorter dimension being three feet or less in length.

17. The method according to claim 14, further comprising:

forming a strip of material in said gap with a non-shrink material, wherein said strip has a compressive strength that is greater than or equal to a compressive strength of the concrete material of said first and second post-tensioned concrete floor slabs.

18. A method for making a concrete floor construction including a first post-tensioned concrete floor slab and a second post-tensioned concrete floor slab separated by a gap, comprising:

forming said first post-tensioned concrete floor slab, wherein said first post-tensioned concrete floor slab includes a first rebar installed therein, and an end portion of said first rebar extends into a space that will become said gap, said first post-tensioned concrete floor slab being post-tensioned in at least a direction substantially parallel to said first rebar;

before a second post-tensioned concrete floor slab has been formed, positioning a cavity-forming device having a cavity at an end portion of said first rebar so that said end portion of said first rebar is inside said cavity, but not securely connecting said cavity-forming device to said end portion of said first rebar;

pouring said second concrete floor slab such that the cavity forming device is positioned within an end of the second concrete floor slab;

forming a second post-tensioned concrete floor slab by tensioning said second concrete floor slab in at least a direction substantially parallel to a second rebar installed within the second concrete floor slab, thus forming said gap between said first post-tensioned concrete floor slab and said second post-tensioned concrete floor slab, wherein said gap has a longer dimension for one side-to-side and a shorter dimension for another side-to-side, said shorter dimension being shorter relative to said longer dimension; and after forming said second post-tensioned concrete floor slab, securely fixing said end portion of said first rebar in the cavity.

19. The method according to claim 18, wherein prior to forming said second post-tensioned concrete floor slab, positioning the second rebar inside said cavity but not securely connecting said cavity-forming device to said second rebar; and in the securely fixing said portion of said first rebar in the cavity step, also securely fixing a portion of the second rebar of said second post-tensioned concrete floor slab in the cavity.

20. The method according to claim 19, further comprising:

forming a strip of material in said gap with a non-shrink material, wherein said strip has a compressive strength that is greater than or equal to a compressive strength of the concrete material of said first and second post-tensioned concrete floor slabs.

* * * * *